US006508161B2

(12) United States Patent
Suzuki et al.

(10) Patent No.: US 6,508,161 B2
(45) Date of Patent: Jan. 21, 2003

(54) SIMPLIFIED PISTON PUMP

(75) Inventors: Takayuki Suzuki, Chiba (JP); Teruo Takamura, Chiba (JP)

(73) Assignee: Suzuki Latex Industry Co., Ltd., Funabashi (JP)

( * ) Notice: Subject to any disclaimer, the term of this patent is extended or adjusted under 35 U.S.C. 154(b) by 0 days.

(21) Appl. No.: 09/809,364

(22) Filed: Mar. 15, 2001

(65) Prior Publication Data

US 2001/0039876 A1 Nov. 15, 2001

(30) Foreign Application Priority Data

May 12, 2000 (JP) ..... 2000-139733

(51) Int. Cl.[7] ..... F04B 9/14
(52) U.S. Cl. ..... 92/23; 92/15
(58) Field of Search ..... 92/8, 13, 15, 20, 92/23, 30; 222/372, 386.5, 327; 604/110

(56) References Cited

U.S. PATENT DOCUMENTS 3,934,586 A * 1/1976 Easton et al. ..... 222/47 X
4,820,272 A * 4/1989 Palmer ..... 604/110
5,026,354 A * 6/1991 Kocses ..... 604/110 X
5,263,934 A * 11/1993 Haak ..... 604/110
5,527,283 A * 6/1996 Swisher, III ..... 604/110
5,634,903 A * 6/1997 Kurose et al. ..... 604/110

* cited by examiner

*Primary Examiner*—Edward K. Look
*Assistant Examiner*—Thomas E. Lazo

(57) ABSTRACT

A simplified piston pump which is featured in that the number of components for the assembling thereof can be minimized, that the assembling thereof can be simplified, and low in manufacturing cost thereof. This simplified piston pump comprises; a cylinder having at least one protrusion formed on the inner surface of a proximal end portion of said cylinder for preventing the piston from slipping out; and a piston shaft having a structure wherein the outer surface of the piston shaft is contacted with the inner surface of the cylinder to prevent the decentering of the piston shaft and wherein a groove is formed thereon to ensure the reciprocative movement of the piston.

6 Claims, 25 Drawing Sheets

SIMPLIFIED PISTON PUMP

BACKGROUND OF THE INVENTION

The present invention relates to a piston pump which is adapted for use in inflating a balloon, a yo-yo balloon, a bag, etc.

As for the means for inflating a balloon, a yo-yo balloon, a bag, etc. by introducing air or water into them, a simplified piston pump is known wherein a piston inserted into a cylinder is reciprocatively moved several times depending on the size of the balloon, etc. so as to inhale air or water into the cylinder and exhale it out of the cylinder through the nozzle thereof. In order to enable the piston of the pump to be reciprocatively moved safely and effectively, it is required that the piston is prevented from slipping out of the cylinder and that the shaft of piston is prevented from being decentered. If the piston slips out of the cylinder during the pumping operation of the pump, the operation of the piston pump is caused to interrupt, thus wasting the time for the inflation operation of the balloon, etc. On the other hand, if the shaft of piston is decentered on the occasion of reciprocative movement thereof, not only the reciprocative movement of the piston becomes difficult, but also a gap is caused to generate between the piston and the cylinder, thus deteriorating the function of the piston pump.

In most of the conventional piston pumps, the prevention of slipping-out of piston and the decentering of the piston shaft are effected by making use of a bearing cap. Namely, the bearing cap is a cap which fits on the cylinder and is provided at the center thereof with a through-hole for allowing the piston shaft to pass through, thus functioning as a bearing for the piston shaft. When a piston is attached to the piston shaft, the piston is caused to impinge against this bearing cap, thereby preventing the piston from slipping out of the cylinder. However, since the bearing cap is employed, the piston or operating grip is required to be attached to the piston shaft after the piston shaft has been inserted into the bearing cap. Therefore, the piston, piston shaft and operating grip are prepared separately, thus increasing the number of parts and also taking a lot of time for the assembling of them, resulting in an increase in manufacturing cost.

For example, Japanese Utility Model Unexamined Publication S56-155,862, Japanese Patent Unexamined Publication H7-310,649, and U.S. Pat. No. 5,655,890 set forth respectively a simplified piston pump of this kind.

Namely, Japanese Utility Model Unexamined Publication S56-155,862 discloses a piston pump which is featured in that the cylinder is made transparent, thereby making it possible to visually recognize the quantity of water introduced into the cylinder. Japanese Patent Unexamined Publication H7-310,649 discloses a piston pump which is featured in that the piston is molded from plastic material, thereby improving the sealing property as well as the smooth movement thereof relative to the cylinder. U.S. Pat. No. 5,655,890 discloses a piston pump which is featured in that both piston and cylinder are respectively provided with a one-way valve. However, since all of these known piston pumps utilize a bearing cap, they would accompany the same problem that the number of parts is increased and a lot of time is required for the assembling of them, resulting in an increase in manufacturing cost.

There is also known a simplified piston pump which has no bearing cap among the simplified piston pumps which are now available in the market. According to this piston pump, the piston shaft is of a cylindrical configuration, so that the outer peripheral surface of piston shaft is continuously contacted with the inner surface of the cylinder, thereby preventing the piston shaft from being decentered. This piston pump however is accompanied with a problem that since the cylindrical piston shaft is always contacted with the inner surface of the cylinder, it is impossible to provide the piston pump with means for allowing it to be contacted with the piston so as to prevent the piston from being slipped out.

BRIEF SUMMARY OF THE INVENTION

Therefore, it is an object of the present invention to provide a simplified piston pump which employs no bearing cap, nevertheless, is capable of preventing the piston from slipping out of the cylinder and also capable of preventing the shaft of piston from being decentered. It is now made possible according to this piston pump to reduce the number of parts, to simplify the manufacturing process and to greatly save the manufacturing cost thereof.

The bearing cap according to the conventional simplified piston pump functions in two ways, i.e. for preventing the piston from slipping out of the cylinder and for preventing the shaft of piston from being decentered.

Therefore, the present inventors have made an extensive study for developing a simplified piston pump which has no bearing cap, but nevertheless, is capable of exhibiting the functions that the conventional bearing cap could provide.

First of all, it has been made possible by the present inventors to prevent the piston from slipping out by forming a protruded portion on the inner wall of proximal end portion of the cylinder. Due to the existence of this protruded portion, the piston is caused to impinge against this protruded portion even if it is tried to pull and disengage the piston from the cylinder, thereby making it possible to prevent the piston from inadvertently slipping out.

Then, it has been studied by the present inventors to realize the prevention of the decentering of piston shaft without necessitating the employment of the bearing cap. According to the aforementioned piston pump having no bearing cap, the piston shaft thereof is made cylindrical so as to make it entirely contact with the inner surface of the cylinder. It is certainly possible in this case to prevent the decentering of the piston shaft, but it is impossible to form a protrusion on the inner surface of the cylinder as proposed by the present invention. Under the circumstances, it has been intensively studied to find out a structure which enables the piston shaft to reciprocatively move even if the protrusion for preventing the slipping-out of piston is formed on the inner surface of the cylinder. As a result, it has been resulted in the invention of a piston shaft having a structure wherein the outer surface of the piston shaft is contacted with the inner surface of the cylinder so as to prevent the decentering of the piston shaft and wherein a groove is formed thereon so as to ensure the reciprocative movement of the piston. More specifically, by constructing the piston shaft in such a manner that irrespective of where the piston shaft is located within the reciprocating region thereof, the outer surface of the piston shaft is partially contacted with the inner surface of the cylinder so as to prevent the axial center of the piston shaft from being dislocated, it becomes possible to prevent the decentering of the piston shaft. For example, if the piston shaft is made into a triangular columnar configuration which is designed to be contacted with the inner surface of the cylinder, three ridge lines corresponding to the peaks of the triangular configuration are always caused to contact with the inner surface of the cylinder irrespective of the location of the piston shaft, thereby preventing the axial center of the piston shaft from being dislocated and hence preventing the decentering of the piston shaft.

Further, by forming the groove of the piston shaft in such a manner that it extends linearly and parallel with the reciprocative moving direction of the piston shaft, the protrusion formed on the inner surface of the cylinder for the prevention of the slipping-out of the piston is allowed to pass through the groove of the piston shaft. Therefore, even if the protrusion is formed on the inner surface of the cylinder, the piston is enabled to reciprocatively move inside the cylinder. It is now possible, through the employment of the piston shaft of the present invention, to prevent the decentering of the piston shaft and to form a protrusion on the inner surface of the cylinder for the prevention of the slipping-out of the piston. Namely, by the provision of the protrusion formed on the inner surface of the cylinder and also by the employment of a piston shaft having the aforementioned decentering-preventive function and groove, the piston can be prevented from slipping out and at the same time, the piston shaft can be prevented from being decentered without necessitating the employment of the bearing cap.

The disuse of bearing cap brings about a positive effect that, as explained hereinafter, the piston, the piston shaft and the operating grip can be integrally molded.

As for the method of forming the aforementioned protrusion on the cylinder, it is possible to employ a method wherein a protrusion member prepared separately is attached to the cylinder by making use of an adhesive, etc., or to employ a method wherein a hole or holes are formed in the cylinder in advance and then, a protrusion member is fitted in the hole, both methods falling within the scope of the present invention.

Another positive effect to be derived from the disuse of bearing cap according to the present invention is the possibility of integrally molding the protrusion and the cylinder. Namely, a portion to be formed into the protrusion is molded integral with the cylinder in such a manner that this portion can be subsequently bent. Accordingly, before the piston is inserted into the cylinder, this portion to be formed into the protrusion is not protruded into the interior of the cylinder, but after the piston is inserted into the cylinder, this portion to be formed into the protrusion is bent inward so as to allow this portion to protrude into the cylinder. It is possible with this method to realize the prevention of slipping-out of the piston and the integral molding of the protrusion and the cylinder, thereby making it possible to greatly reduce the number of parts as well as the number of molds, and to simplify the assembling process, thus saving the manufacturing cost.

According to the present invention, there are provided:

(1) A simplified piston pump which is enabled to function through a reciprocative movement of piston, said piston pump comprising a cylinder having at least one protrusion formed on the inner surface of a proximal end portion of said cylinder for preventing the piston from slipping out, and a piston shaft having a structure wherein the outer surface of the piston shaft is contacted with the inner surface of the cylinder so as to prevent the decentering of the piston shaft and wherein a groove is formed thereon so as to ensure the reciprocative movement of the piston.

(2) The simplified piston pump as set forth in above item (1) wherein said at least one protrusion is formed integral with a main body of said cylinder.

(3) The simplified piston pump as set forth in above item (1) wherein said at least one protrusion is fastened to a main body of said cylinder.

(4) The simplified piston pump as set forth in above item (1), (2) or (3) wherein said piston, said piston shaft and an operating grip are formed integral with each other.

In this specification, the expression of: "a proximal end portion of cylinder" means a portion of the cylinder which is located closer to the operating grip and is not intended to limit the location thereof to a specific point. Namely, when the protrusion for preventing the slipping-out or disengagement of piston is formed closer to the operating grip, the stroke of the piston can be made longer proportionally.

DETAILED DESCRIPTION OF THE INVENTION

Figure 1:
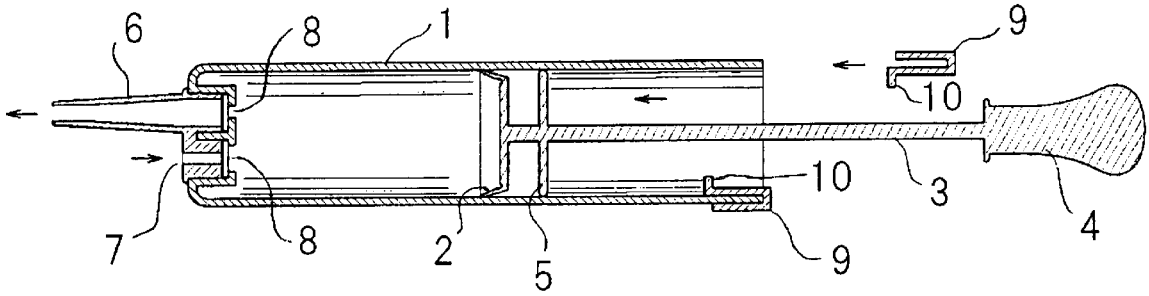
FIG. 1 is a cross-sectional view of a piston pump wherein a protrusion member is attached or being attached to the cylinder thereof.

Next, the present invention will be explained in detail.

By the expression of: "a simplified piston pump which is enabled to function through a reciprocative movement of piston", it is intended to mean a piston pump having a structure wherein a piston having sealing property is inserted in a cylinder, and the piston is enabled to reciprocatively move inside the cylinder so as to permit air or water to enter from an inlet port provided with a one-way valve and then to eject the air or water out of a nozzle constituting a discharge port. This simplified piston pump can be used in such a manner that the nozzle thereof is inserted into a balloon for instance and then the piston is reciprocatively moved a suitable number of times depending on the size of the balloon, thereby inflating the balloon.

As for the articles to be inflated by the piston pump of the present invention, it usually includes a balloon, a yo-yo balloon and a bag, but there is not any particular limitation on the articles to which the piston pump of the present invention is applicable.

The piston pump of the present invention is not provided with a bearing cap, Namely, since the piston shaft is no more required to be inserted into the bearing cap, the piston shaft can be molded integral with the piston and the operating grip. The term of "molded integral with" means that a plurality of members can be molded into an integral body using a plastic material. It is of course possible, if required, to separately prepare the piston in separate from the piston shaft, or the piston shaft from the operating grip, which are then assembled separately.

One of the constituent features of piston pump of the present invention is the provision of a protrusion on the inner wall of proximal end portion of the cylinder. Due to the existence of this protruded portion, the piston is caused to impinge against this protruded portion even if it is tried to pull and disengage the piston from the cylinder, thereby making it possible to prevent the piston from slipping out.

One of the method of forming this protrusion or protruded portion is to fasten a protrusion member having a protruded portion to the cylinder. In this case, the protrusion member may be fastened to the cylinder by making use of an adhesive. Alternatively, the protrusion member may be fitted in a hole formed in advance in the cylinder. The latter method of fitting the protrusion member on the cylinder may be optionally selected as long as the piston can be prevented from slipping out of the cylinder. For example, the protrusion member may be fitted on the cylinder from outside thereof, from inside thereof, or from the proximal edge thereof.

As for the configuration of the protrusion member, there is not any particular limitation as long as it is capable of preventing the piston from slipping out of the cylinder. The number of the protrusion member may be also optionally selected, i.e. one or more.

The protrusion may be molded integral with the cylinder. If the protrusion member is made resilient and bendable in configuration, the slip-out of the piston can be prevented by simply introducing the piston into the cylinder in the assembling of the piston pump. Namely, when the piston is impinged against the protrusion on the occasion of introducing the piston into the cylinder, the protrusion is caused to temporarily escape toward the outside of the cylinder, thereby allowing the piston to move into the cylinder. As soon as the piston is passed through a portion of the cylinder where the protrusion is located, the protrusion is allowed to return to the original position due to its resiliency, thereby allowing the protrusion to function as a stopper for the piston. Since the protrusion is required to be resilient in this case, the cylinder should desirably be formed of a resilient plastic material.

The protrusion member may be molded integral with the cylinder with the protrusion member thus molded being made subsequently bendable. In this case, the protrusion member is not projected inside the cylinder before the piston is inserted into the cylinder, but the protrusion member is bent inside the cylinder so as to form the protruded portion for preventing the slip-out of the piston. In order to make the protrusion member bendable, the material of cylinder should desirably be selected from plastic materials.

Figure 17:
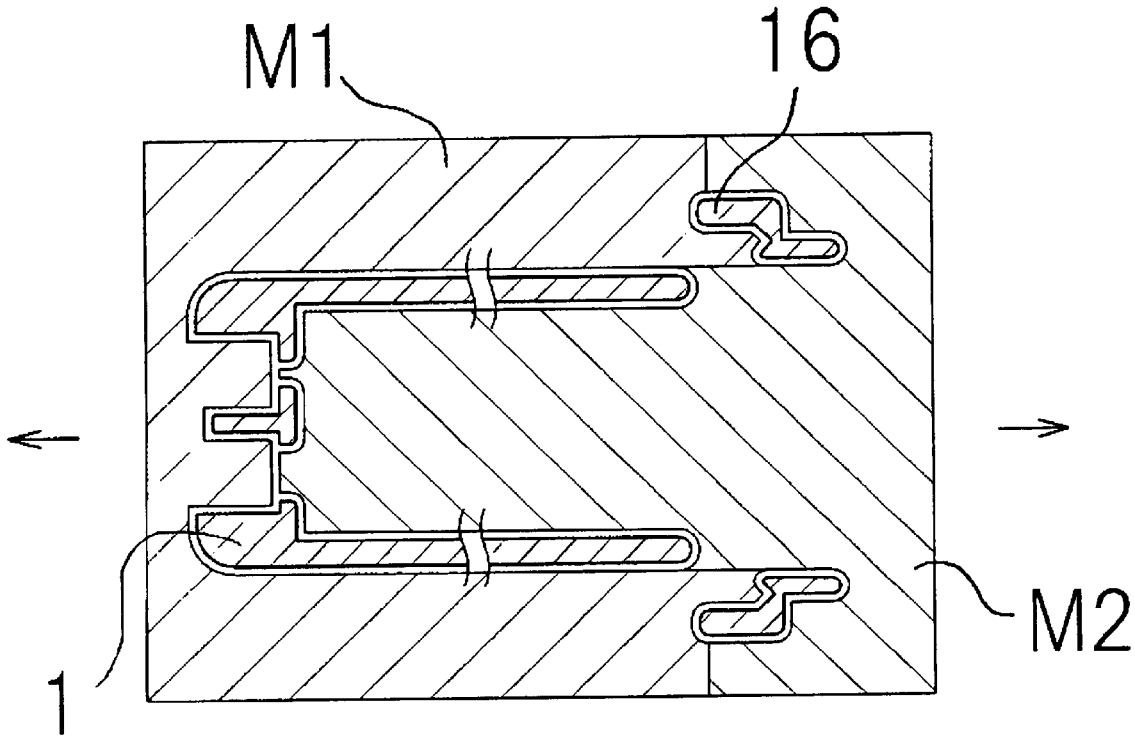
FIG. 17 is a cross-sectional view of a mold for forming a cylinder provided on the outer side thereof with bendable protrusions.

If the bendable protrusion member is positioned outside the cylinder, the mold for the cylinder can be made into a two-piece mold, i.e. a female mold for the outside of the cylinder and a male mold for the inside of the cylinder (see FIG. 17). Further, since the male mold for the inside of the cylinder can be pulled out unidirectionally in this case, one end of the cylinder can be molded into a cap-like closed configuration. Therefore, the flange portion constituting the nozzle side of the cylinder can be molded integral with the main body of the cylinder, thereby making it possible to reduce the number of parts.

In order to realize the sealing property and smooth operability of piston relative to the cylinder, the piston can be formed into a configuration exhibiting elasticity, preferably by making use of a plastic material.

The piston shaft is constructed in such a manner that irrespective of where the piston shaft is located within the reciprocating region thereof, the outer surface of the piston shaft is partially contacted with the inner surface of the cylinder so as to prevent the axial center of the piston shaft from being dislocated. Further, in order to escape the protruded portion formed on the inner wall of the cylinder, the piston shaft is provided with a groove.

Figure 4:
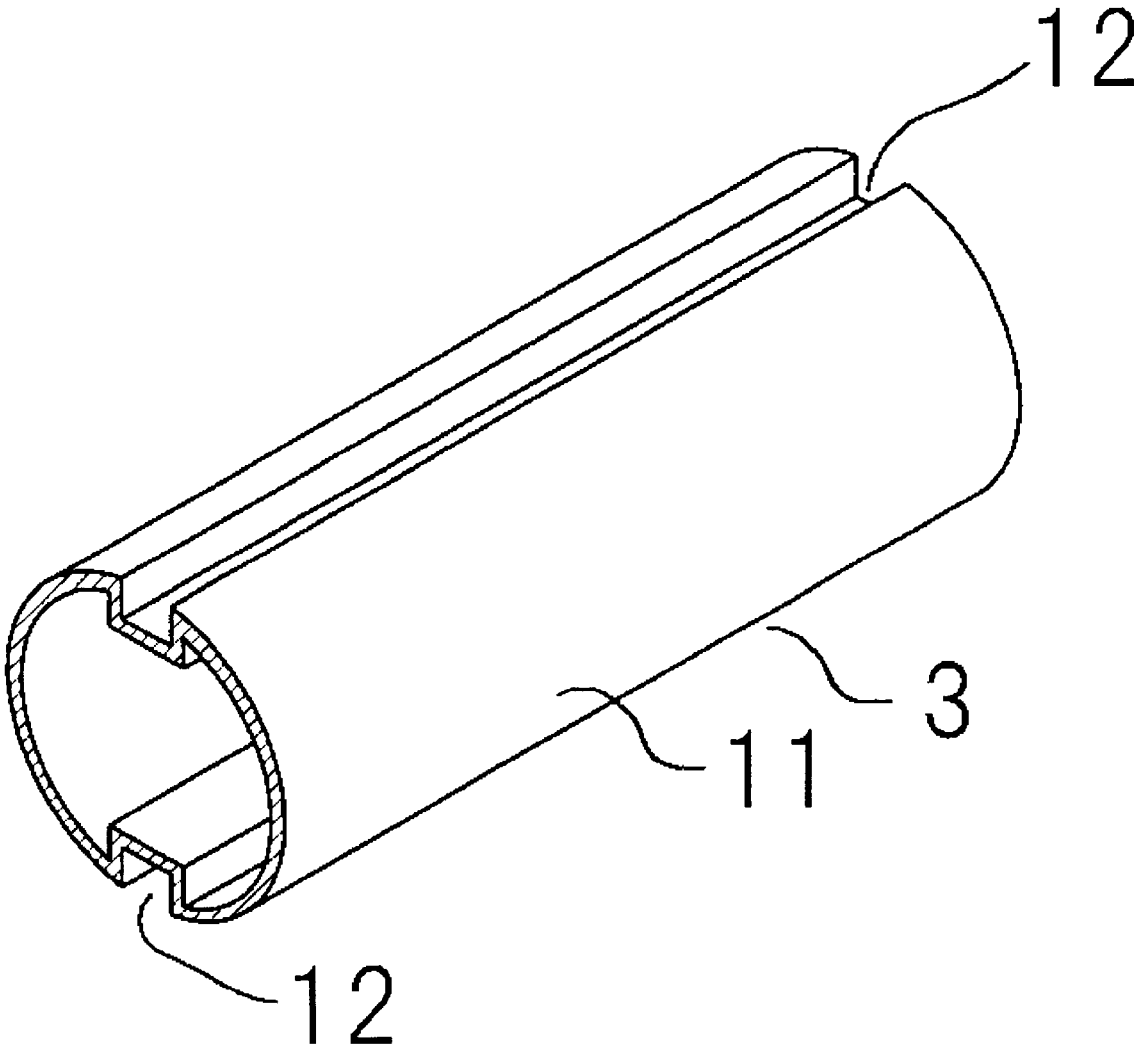
FIG. 4 is a perspective view showing a cylindrical piston shaft representing one example of the piston shaft.
Figure 5:
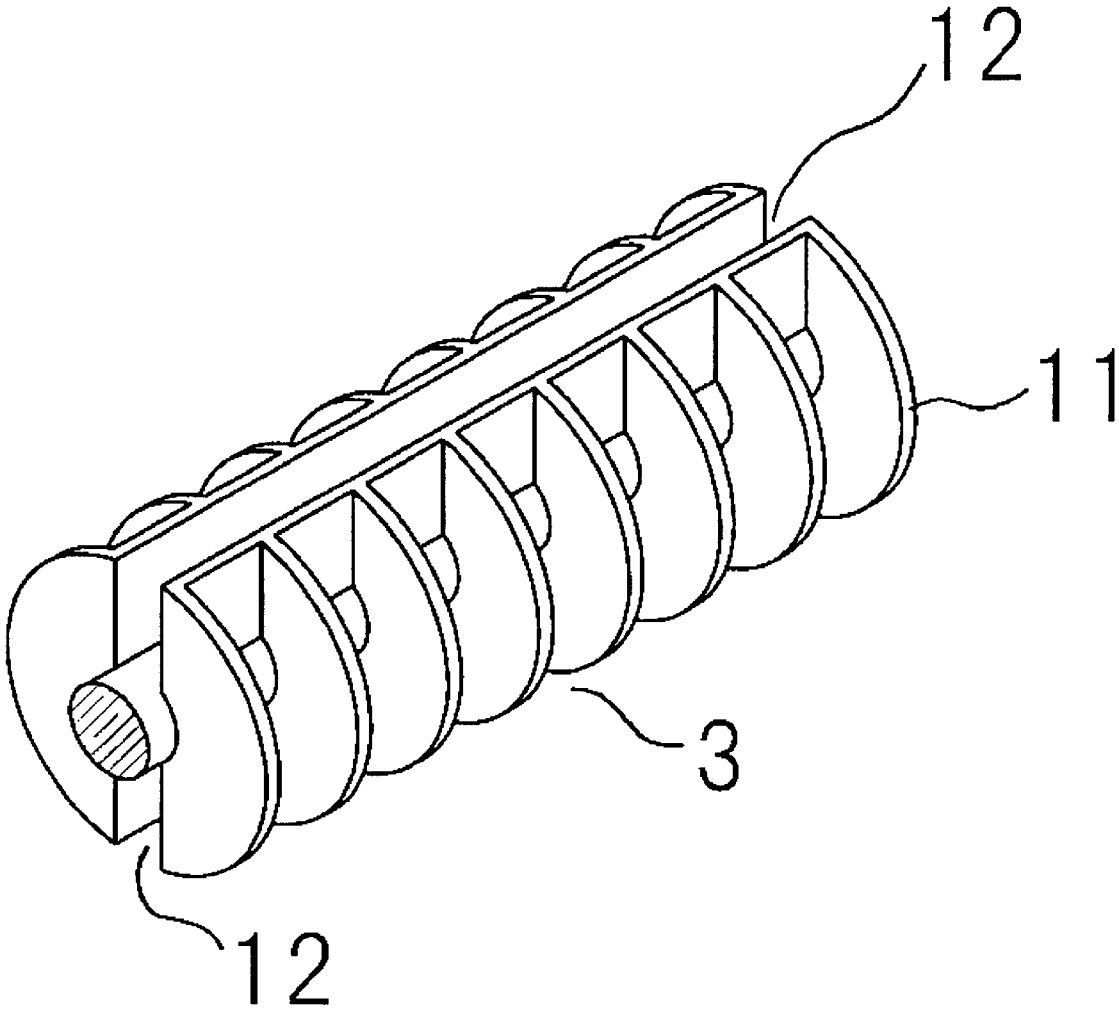
FIG. 5 is a perspective view showing a cylindrical piston shaft having a configuration wherein a plurality of disk-like members are arrayed at intervals along the longitudinal direction of the piston shaft and representing another example of the piston shaft.

As for the configuration of the piston shaft, the piston shaft can be made into a triangular columnar configuration (FIG. 6), or into a cylindrical configuration provided with a groove (FIG. 4). Alternatively, the piston shaft can be formed into a configuration wherein a plurality of disk-like members are arrayed at intervals along the longitudinal direction of the piston shaft, and also grooves are formed along the longitudinal direction of the piston shaft (FIG. 5).

Figure 3:
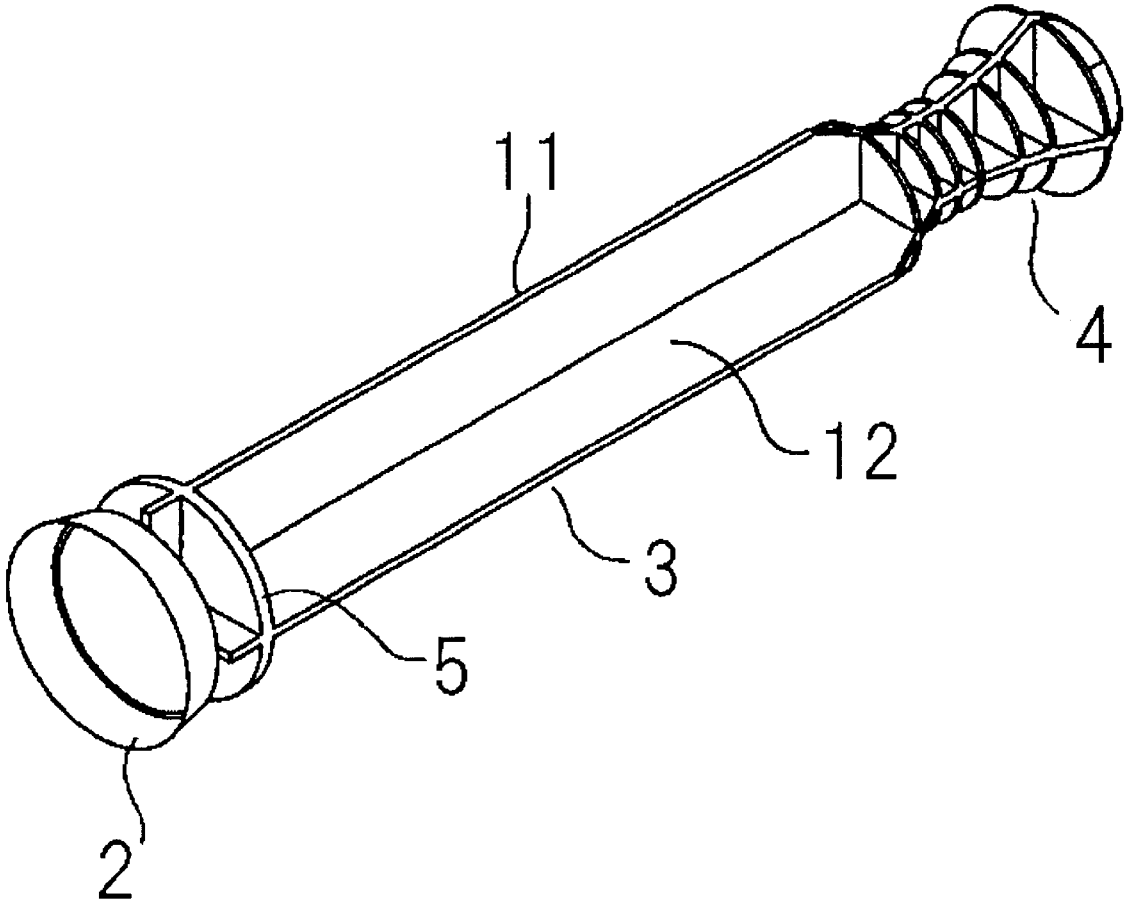
FIG. 3 is a perspective view showing a structure wherein a piston, a piston shaft and an operating grip are molded integral with each other.

The piston shaft can be also formed into a cruciform sectional configuration wherein the portions not to be contacted with the inner wall of cylinder are made into grooves (FIG. 3). In this case, the contacting area between the cylinder and the piston shaft can be minimized, thereby realizing smoother reciprocative movement of the piston. Further, since the volume of the piston shaft can be reduced, the cost for the raw material can be saved.

The groove should preferably be formed linearly and parallel with the direction of reciprocative movement of the piston shaft. Since the protrusion formed on the inner wall of the cylinder is designed to pass through the groove formed in the piston shaft, the provision of the protrusion on the inner wall of the cylinder would not hinder the reciprocative movement of the piston shaft. The configuration of the piston shaft can be optionally selected as long as the decentering of the piston shaft can be prevented and at the same time, the piston shaft can pass through the protrusion. The number of groove can be determined depending on the number of the protrusion formed on the cylinder.

A colliding portion which is enabled to be impinged against the protrusion of the cylinder may be formed at a portion of the piston shaft which is close to the piston, thereby providing the piston shaft with a function for preventing the piston from being damaged. Namely, when the colliding portion is formed in this manner, the piston is prevented from being contacted with the protrusion formed on the cylinder, the piston can be prevented from being deformed. If the piston is deformed, a gap may be generated between the piston and the cylinder, thereby deteriorating the function of the piston pump.

It is possible, by the employment of the protrusion formed on the inner wall of the cylinder and of the piston shaft having a decentering function and a groove portion, to prevent the piston from being slipped out and to prevent the piston shaft from being decentered without necessitating the employment of a bearing cap. Since the bearing cap can be dispensed with, the piston, the piston shaft and the operating grip can be integrally formed, it is possible to greatly reduce the number of parts and to simplify the assembling process, thus saving the manufacturing cost of the simplified piston pump.

Next, specific examples of the present invention will be explained with reference to the drawings. However, it should be construed that the present invention is not limited to the following examples.

FIG. 1 is a cross-sectional view of a simplified piston pump of the present invention. Referring to FIG. 1, a cylinder 1 is formed of a cap-like configuration whose closed end thereof is provided with an inlet hole and with an outlet hole. An integrated molded body comprising a nozzle 6 and an intake port 7 is attached to this closed end of the cylinder 1. Since a rubber valve 8 is interposed between the cylinder 1 and the nozzle 6 as well as between the cylinder 1 and the intake port 7, air or water is enabled to move only in one direction. The cylinder may not be the cap-like configuration but can be made cylindrical. In such a case, a flange provided with a couple of holes is attached to one end of the cylinder, and then, a nozzle and an intake port can be fitted therein. A piston 2 is introduced into the cylinder 1, wherein the piston 2, the piston shaft 3 and the operating grip 4 are integrally molded for the purpose of reducing the number of parts. When the piston 2 is moved toward the operating grip 4, air or water is allowed to be introduced via the intake port 7 into the cylinder 1. On the other hand, when the piston 2 is moved toward the nozzle 6, the air or water in the cylinder 1 is allowed to be injected out of the cylinder 1 via the nozzle 6. By reciprocatively moving the piston 2, a balloon, a yo-yo balloon, etc. can be inflated. In order to make the piston 2 into an elastic configuration, the piston 2 is formed from a plastic material, thereby providing the piston 2 with sealing property and smooth operability relative to the cylinder (see Japanese Patent Unexamined Publication H7-310,649).

Next, the prevention of the slipping-out of the piston and the prevention of the decentering of the piston shaft will be explained in detail with reference to the following examples.

EXAMPLE 1

Methods for Fastening the Protrusion Member as a Separate Member

Figure 2:
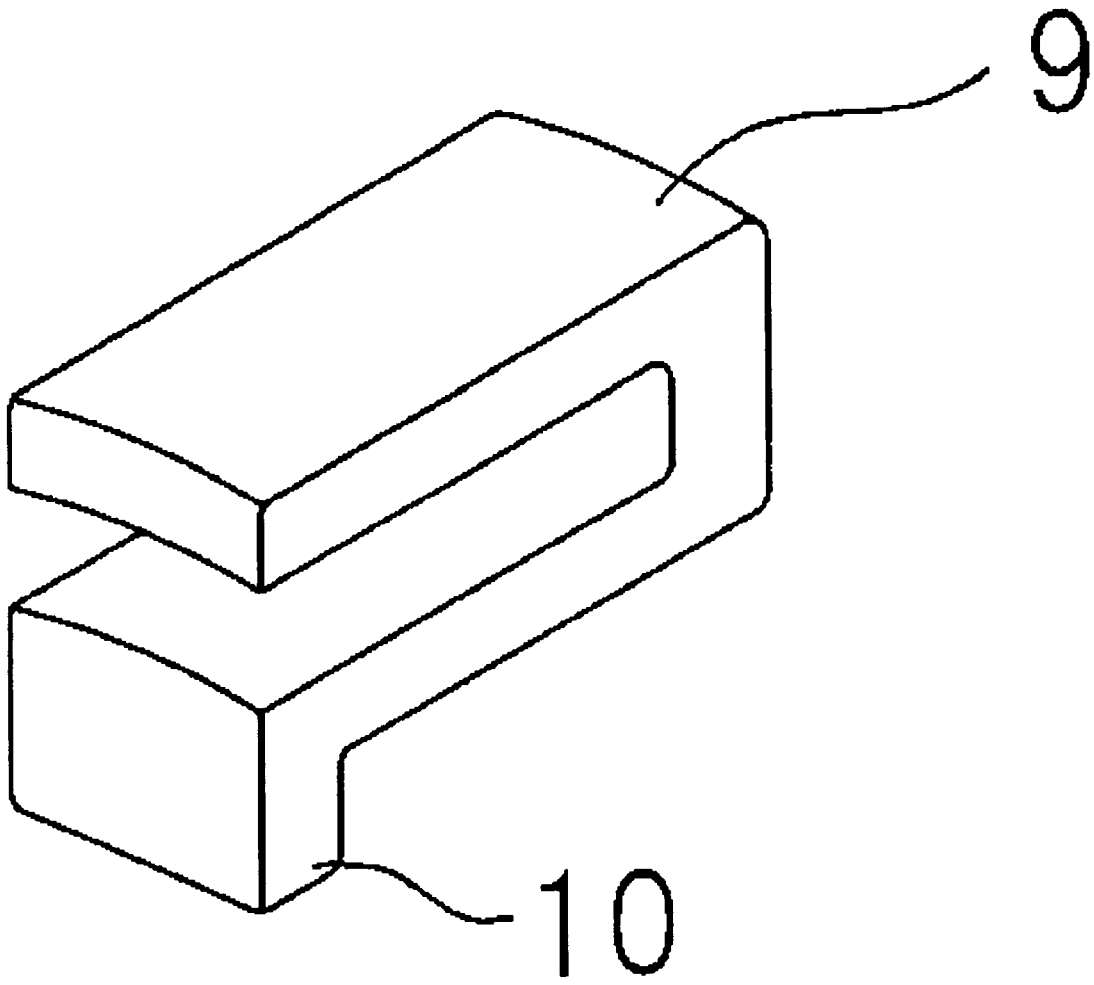
FIG. 2 is a perspective view showing in detail the protrusion member.

First of all, as one of the methods for forming a protrusion for the prevention of the slipping-out of the piston, a method of fastening a protrusion member to the cylinder will be explained. As shown in FIG. 1, after the piston 2 is inserted into the cylinder 1, the protrusion member 9 having a protruded portion 10 is fitted on the cylinder 1. This protrusion member 9 can be fixed to the cylinder 1 by making use of an adhesive, etc. The protruded portion 10 is projected inside the cylinder 1 so as to enable a flange 5 formed on the piston shaft 3 to impinge against this protruded portion 10, thereby preventing the piston 2 from being slipped off as the flange 5 is impinged against this protruded portion 10. Details of this protruded portion 10 is shown in FIG. 2. As for the configurations of the protrusion member 9 and protruded portion 10, there is not any particular limitation as long as they are capable of preventing the piston from slipping out of the cylinder. The number of the protrusion member 9 may be optionally selected, i.e. one or more.

FIG. 3 shows a perspective view of a molded integral structure comprising a piston, a piston shaft and an operating grip. The piston shaft 3 is formed of a cruciform sectional configuration and the external surface 11 of the piston shaft is always contacted with the inner wall of the cylinder, thereby preventing the decentering of the piston shaft. Since the contacting area between the cylinder and the piston shaft is small, the reciprocative movement of the piston can be made smoother. Further, since the volume of the piston shaft itself is small, the cost for the raw material can be saved.

The portions which are not contacted with the inner wall of the cylinder are made into groove portions 12. Since the protruded portions formed inside the cylinder are allowed to pass through the grooves 12 of the piston shaft, the provision of the protruded portions formed on the inner wall of the cylinder would not hinder the reciprocative movement of the piston. Further, since the groove portions are formed linearly and parallel with the direction of the reciprocative movement of the piston shaft, the linear reciprocative movement of the piston shaft can be achieved. It is now possible, by the employment of the piston shaft of the present invention, to prevent the decentering of the piston shaft and to form the protruded portion on the inner wall of the cylinder.

When the piston is impinged against the protruded portion on the inner wall of the cylinder on the occasion of the reciprocative movement of the piston, the piston may possibly be deformed. Once the piston is deformed, a gap is caused to generate between the piston and the cylinder, thereby deteriorating the function of the piston pump. However, when the flange 5 is formed on the piston shaft 3 so as to render the flange 5 to impinge against the protruded portion on the inner wall of the cylinder, the deformation of the piston can be prevented.

As for the configuration of the piston shaft 3 provided with the groove portions, there is not any particular limitation as long as the piston shaft is always partially contacted with the inner wall of the cylinder so as to prevent the decentering of the piston shaft. Further, there is also not any particular limitation as to the configuration of the groove portions as long as they are capable of escaping the protruded portions formed on the inner wall of the cylinder on the occasion of the reciprocative movement of the piston shaft. The number of groove portions 12 may be determined depending on the number of the protruded portions formed on the inner wall of the cylinder.

Figure 6:
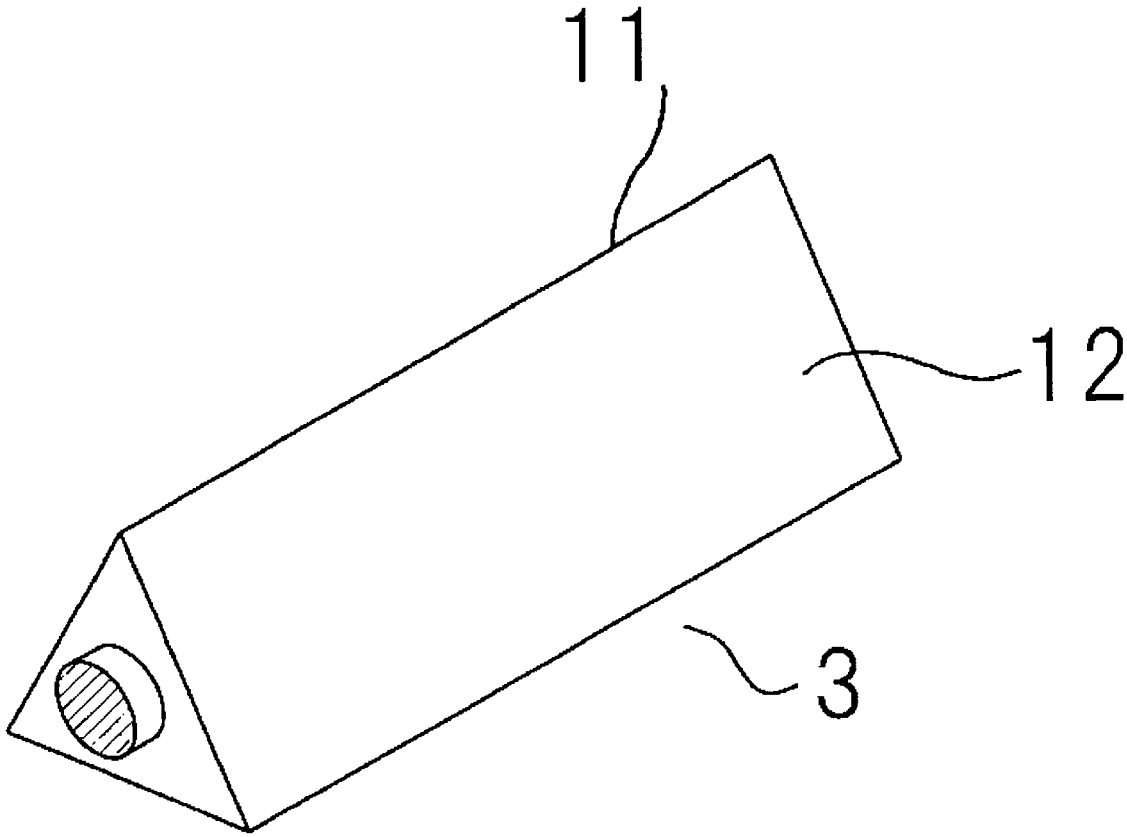
FIG. 6 is a perspective view showing a cylindrical piston shaft having a triangular columnar configuration.

For example, the configuration of the piston shaft 3 provided with the groove portions may be as shown in FIGS. 4, 5 or 6. The piston shaft shown in FIG. 4 is constructed such that groove portions 12 are formed in the cylindrical piston shaft. The piston shaft shown in FIG. 5 is constructed such that groove portions 12 are formed along a shaft having an array of disk-like flanges. The piston shaft shown in FIG. 6 is formed of a triangular columnar body wherein three ridge lines corresponding to the peaks of the triangular columnar body are always caused to contact with the inner surface of the cylinder, thereby preventing the decentering of the piston shaft. In this case, the side portions 12 of the triangular columnar body are not contacted with the inner wall of the cylinder, so that they can be utilized as they are as groove portions.

Figure 7:
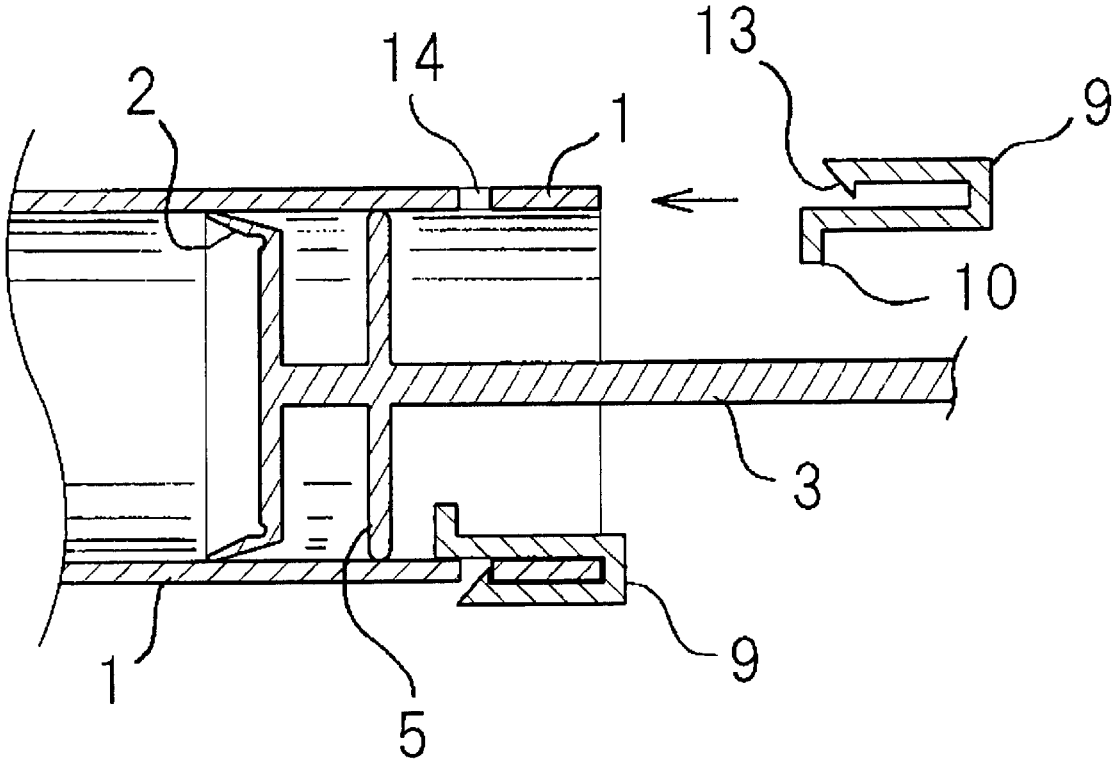
FIG. 7 is a cross-sectional enlarged view showing part of a piston pump wherein a protrusion member is attached or being attached to the cylinder thereof.

As one of the methods for attaching a protrusion member to the cylinder, it is possible to employ a method of attaching the protrusion member to the cylinder by making use of a hole or holes which are formed in advance in the cylinder. FIG. 7 illustrates in detail the cross-sectional view of such a construction. On the occasion of mounting the protrusion member 9 on the cylinder 1, a wedge-like portion 13 of the protrusion member 9 is fitted in a hole 14 formed in advance in the cylinder, thereby fixing the protrusion member 9 to the cylinder. According to this method, the protrusion member 9 can be fixed to the cylinder without necessitating an adhesive.

Figure 8:
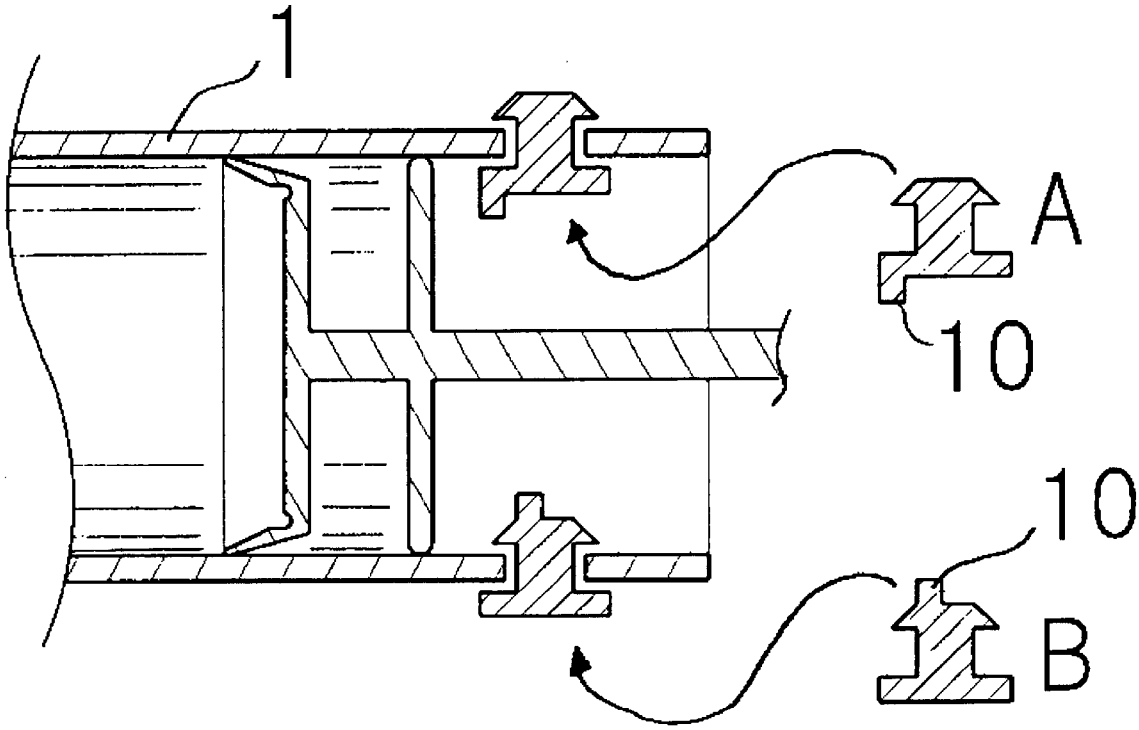
FIG. 8 is a cross-sectional enlarged view showing part of a piston pump wherein a protrusion member is fastened or being fastened to the cylinder thereof.
Figure 9:
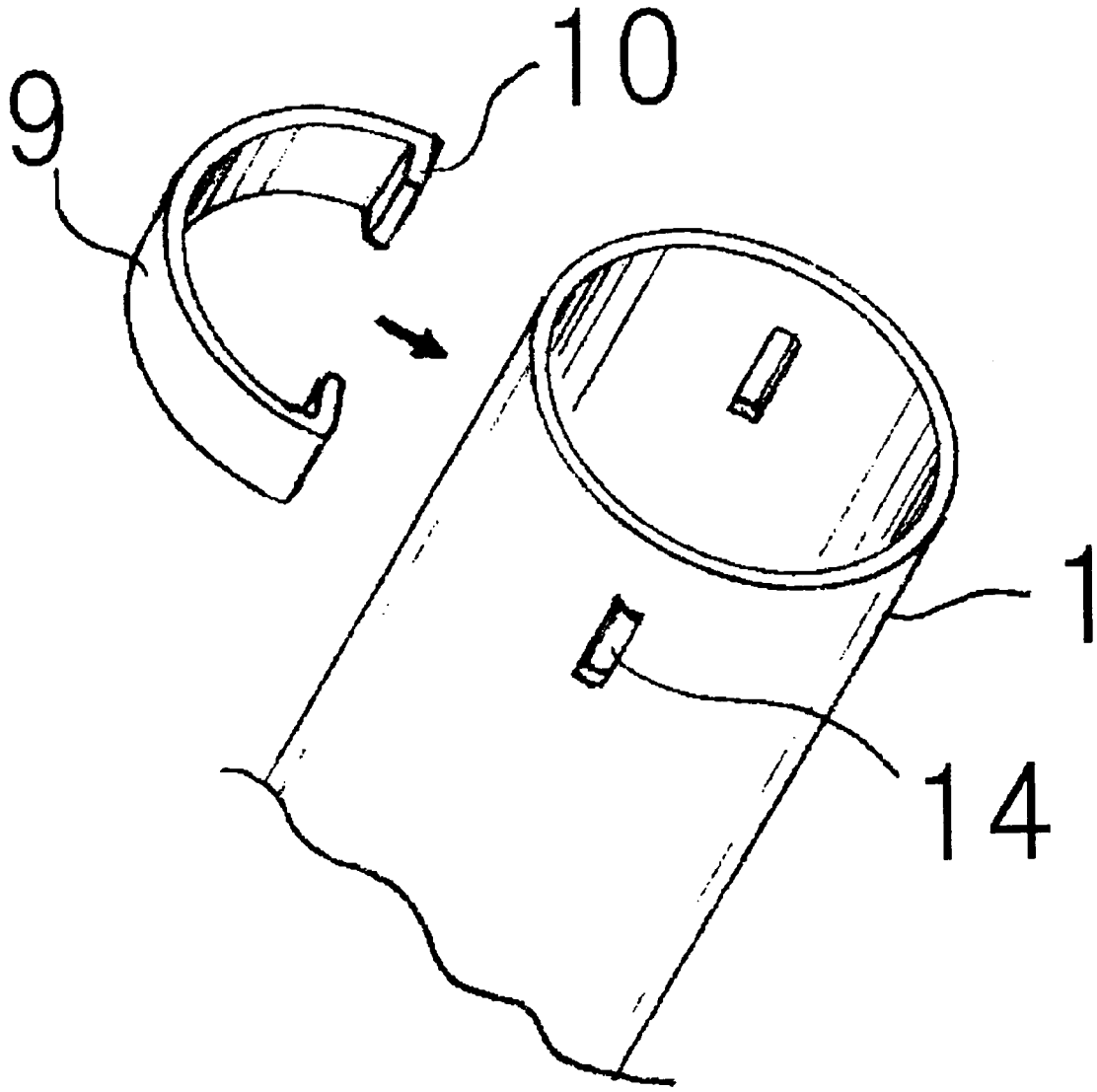
FIG. 9 is a perspective view partially showing one example of combination between the cylinder and the protrusion member.
Figure 10:
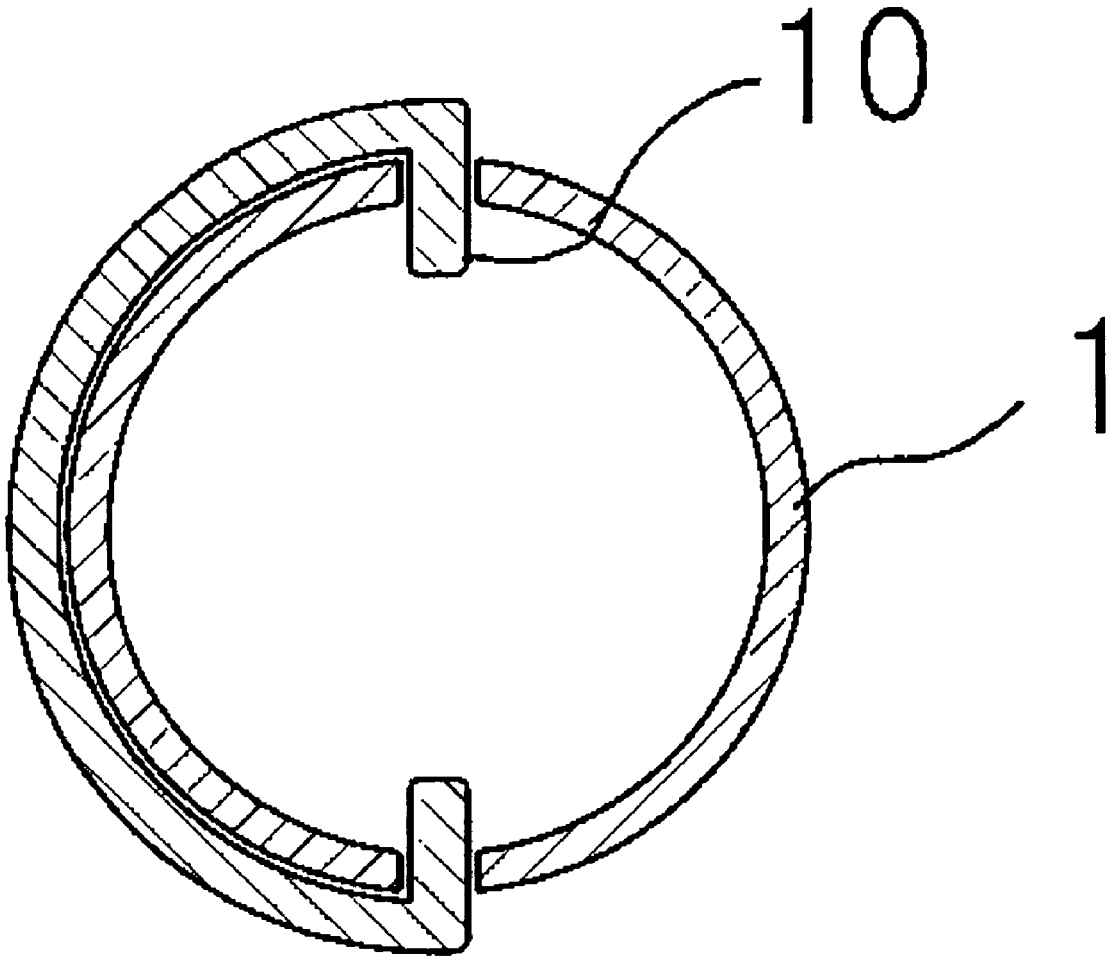
FIG. 10 is a cross-sectional view showing a state where the protrusion member is fitted on the cylinder.

As for the configuration of the protrusion member 9 and the manner of attaching the protrusion member 9 to the cylinder, they may be optionally selected as long as the piston is enabled to be prevented from being inadvertently slipped off by the protrusion member 9. For example, they may be constructed as shown in FIGS. 8 and 9. Namely, the protrusion member A shown in FIG. 8 is designed to be attached to the cylinder from the inside of the cylinder, while the protrusion member B shown in FIG. 8 is designed to be attached to the cylinder from the outside of the cylinder. In the embodiment shown in FIG. 9, the protruded portions 10 are fitted in the holes 14 formed in the cylinder thereby to prevent the slip-out of the piston. The cross-sectional view of FIG. 10 shows a state where the protrusion member 9 is fitted on the cylinder 1. Only a single piece of the protrusion member according to this example may be sufficient for preventing the slip-out of the piston, but a plurality of the protrusion members may be employed likewise as desired. The fixing position of the protrusion member should desirably be as close to the proximal end of the cylinder (near the operating grip) as possible in order to make the stroke of the piston larger.

As for the material for the piston pump other than that of the rubber valve, polypropylene is more preferable since it is cheap and excellent in flexibility. With respect to the protrusion member according to Example 1, the material thereof may be changed as required, the color thereof may be differentiated from that of the cylinder, and the design thereof may be suitably modified. When the cylinder may be made transparent or semi-transparent, thereby making it possible to recognize the quantity of water introduced into the cylinder.

EXAMPLE 2

Methods for Forming a Bendable Protruded Portion Integral with the Cylinder

According to Example 1, the protruded portion for the prevention of the slip-out of piston is formed as a separate member from the cylinder and subsequently attached to the cylinder. However, it has been made possible by the present inventors to mold the protruded portion integral with.the cylinder by making the cylinder partially bendable.

Figure 11:
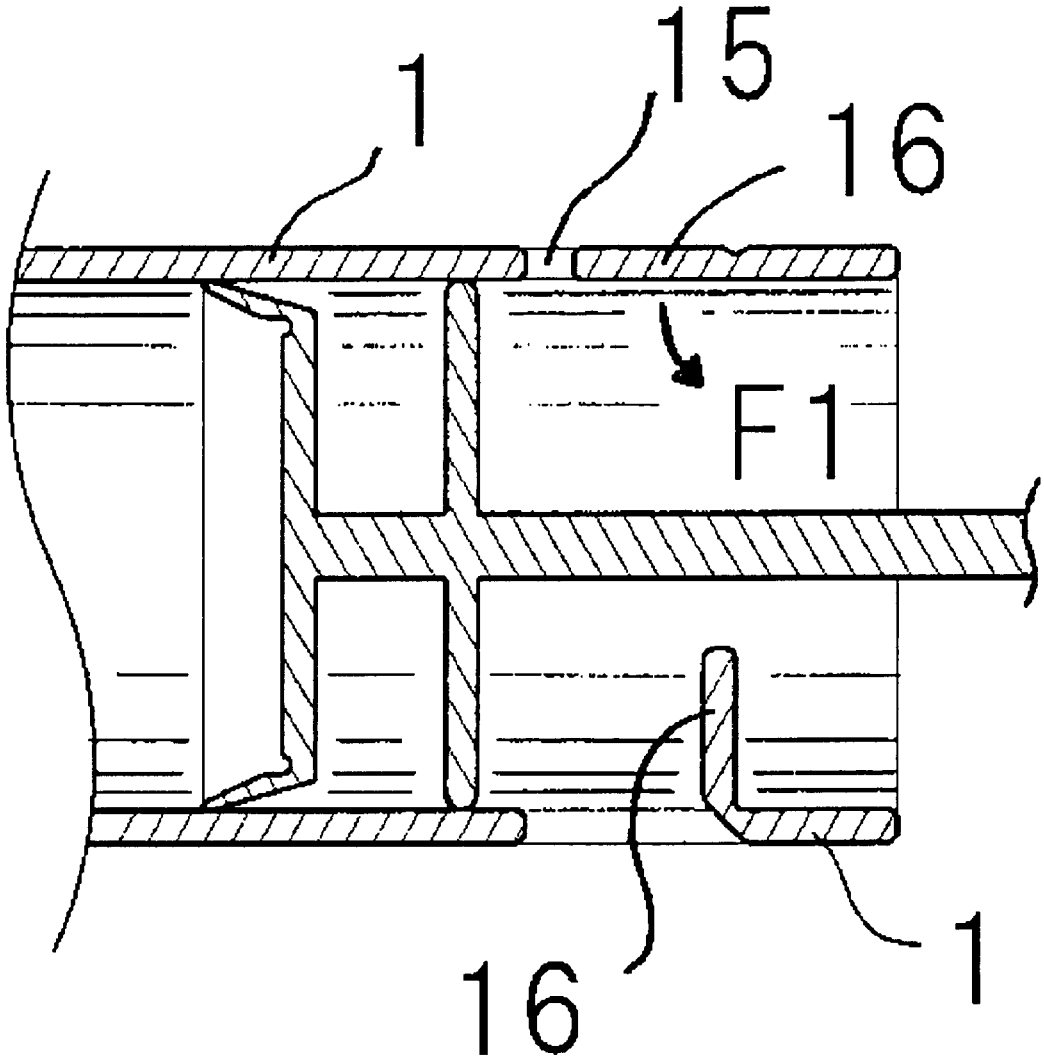
FIG. 11 is a cross-sectional enlarged view showing part of a piston pump wherein protrusion members are formed bendably to the cylinder thereof.
Figure 12:
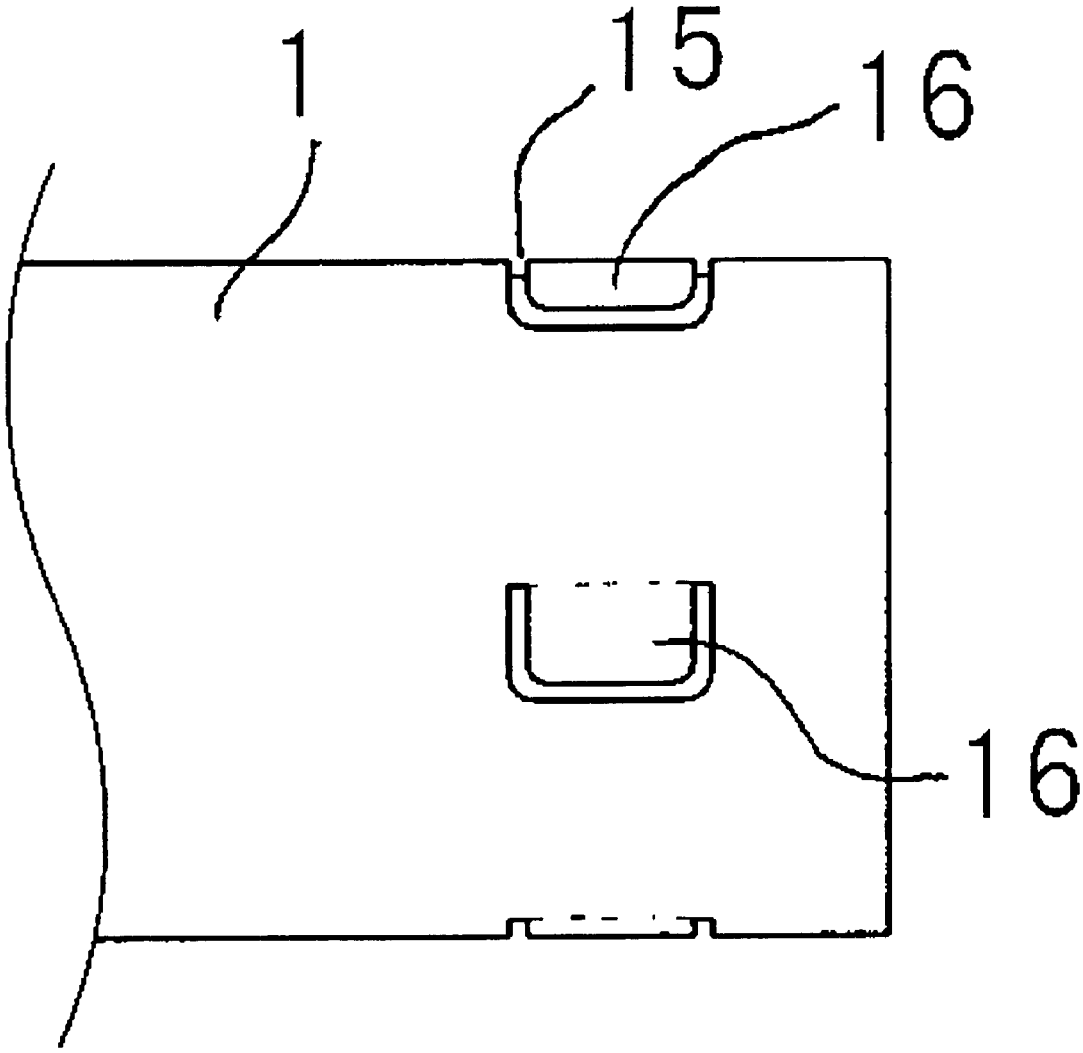
FIG. 12 is a side view showing one example of the cylinder provided with protrusion members which are formed bendably to the cylinder.
Figure 13:
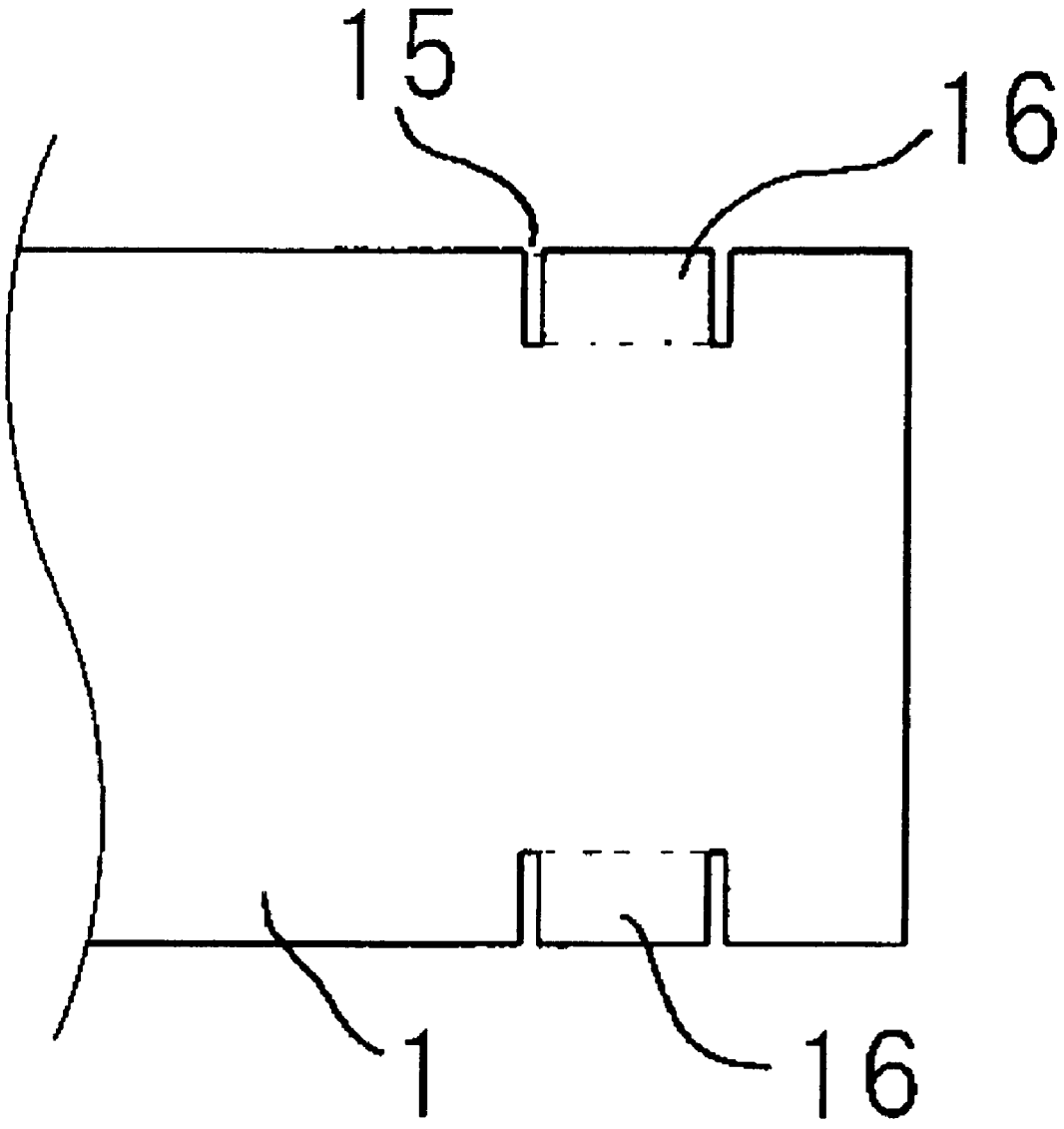
FIG. 13 is a side view showing one example of the cylinder provided with protrusion members which are formed bendably to the cylinder.
Figure 14:
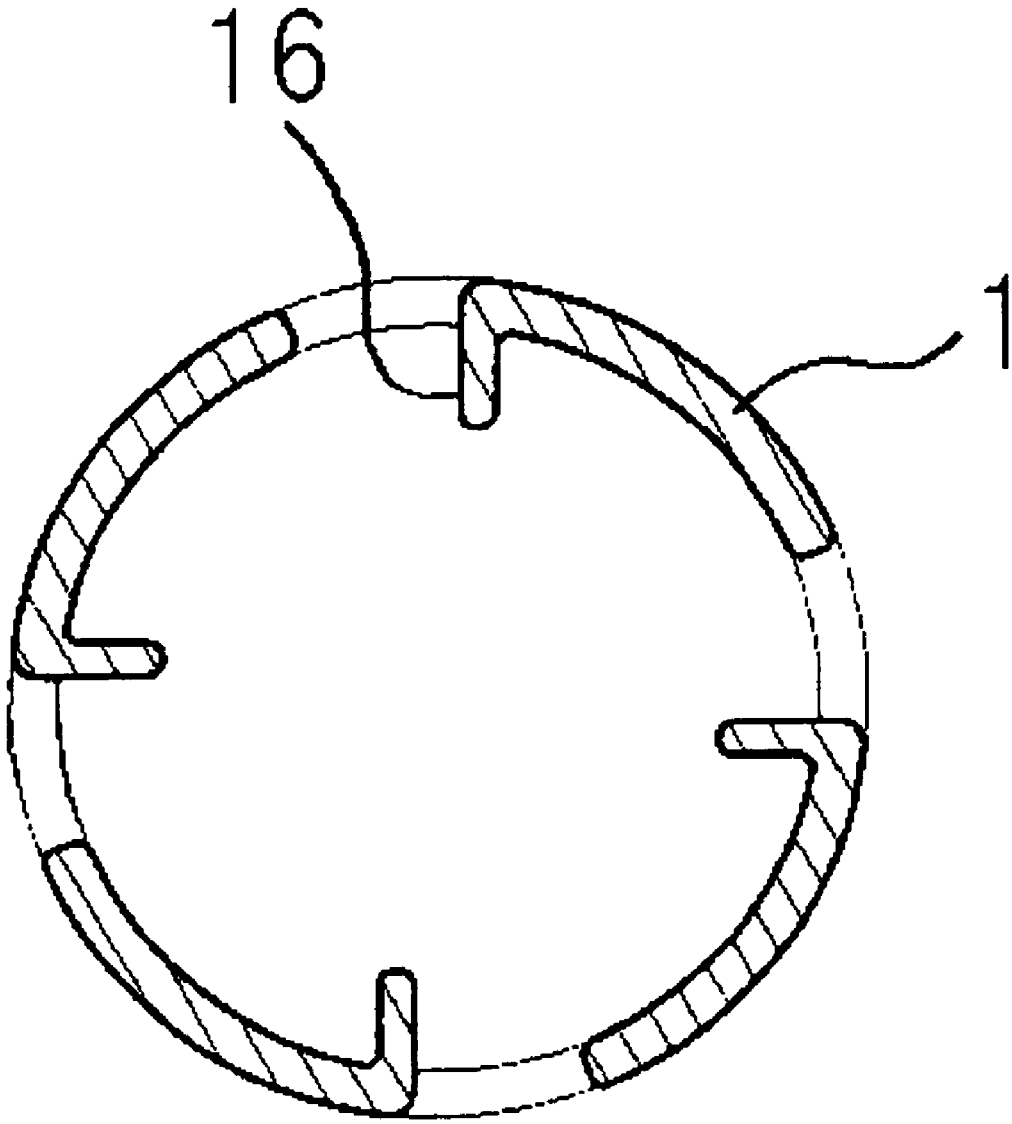
FIG. 14 is a cross-sectional view of one example of cylinder showing a state where the protrusion members are bent inward.
Figure 15:
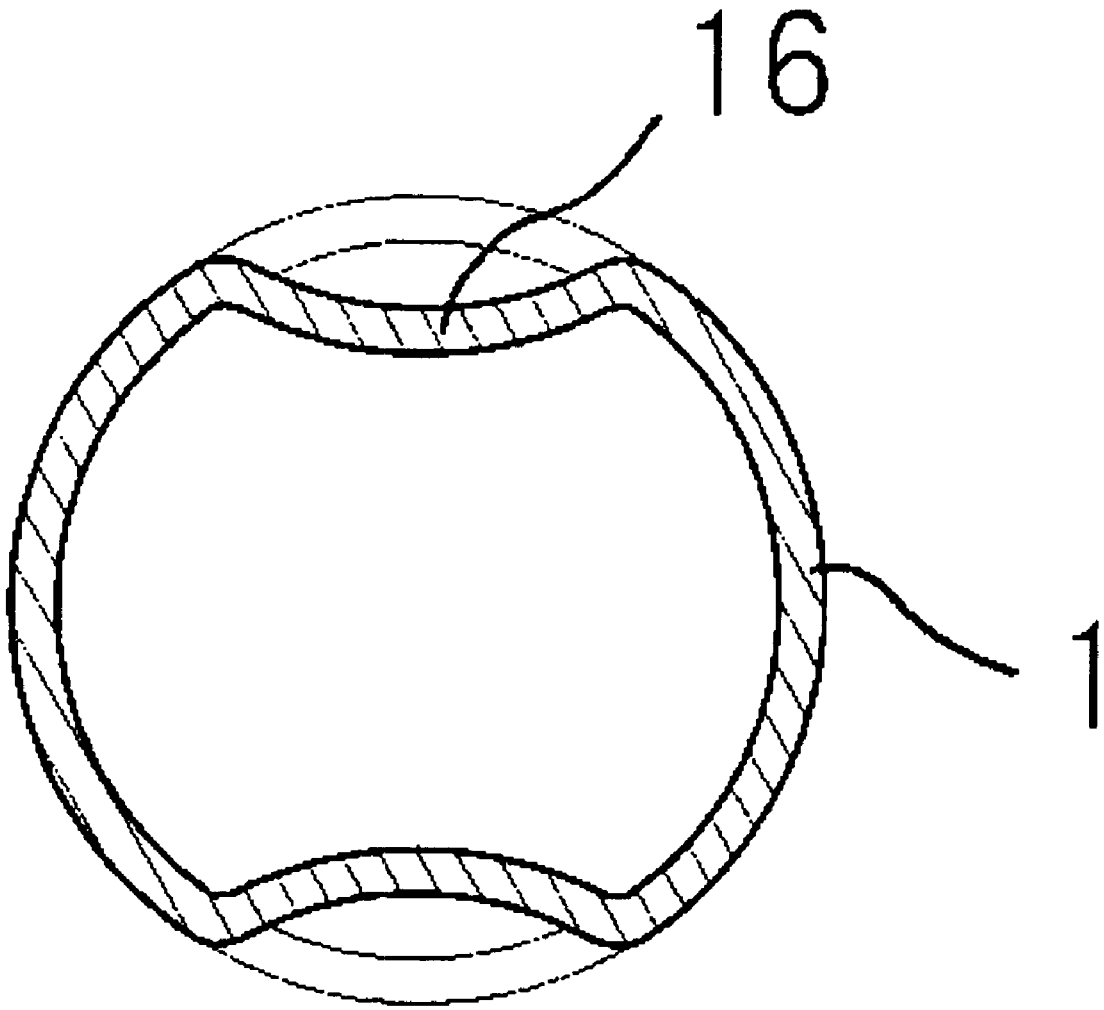
FIG. 15 is a cross-sectional view of one example of cylinder showing a state where the protrusion members are bent inward.

As shown in FIG. 11 illustrating the sectional view of part of the piston pump, a cut portion 15 is formed in the cylinder 1 thereby forming a bendable protrusion portion 16. Since the protrusion portion 16 is made bendable, when this bendable protrusion portion 16 is bent inside the cylinder as indicated by the arrow F1, the slip-out of the piston can be prevented. The number of this bendable protrusion portion 16 may be only one or more. As for the configuration of this bendable protrusion portion 16, it may be optionally selected as long as it is capable of preventing the slip-out of the piston. For example, it may be constructed as shown in FIGS. 12 and 13. Namely, when the bendable protrusion portion 16 shown in FIG. 12 is bent inside the cylinder 1, the cross-sectional view thereof will become as shown in FIG. 14. On the other hand, when the bendable protrusion portion 16 shown in FIG. 13 is bent inside the cylinder 1, the cross-sectional view thereof will become as shown in FIG. 15.

When the prevention of the slip-out of the piston is achieved by the method as described above, the protruded portion for the prevention of the slip-out of the piston can be molded integral with the cylinder, so that the number of parts can be reduced and the manufacturing cost thereof can be saved.

In view of the easiness for bending the bendable protrusion portion formed integral with the cylinder and also in view of the manufacturing cost, the material for the cylinder should desirably be selected from a resilient and unbreakable plastics such as polypropylene.

EXAMPLE 3

Figure 16:
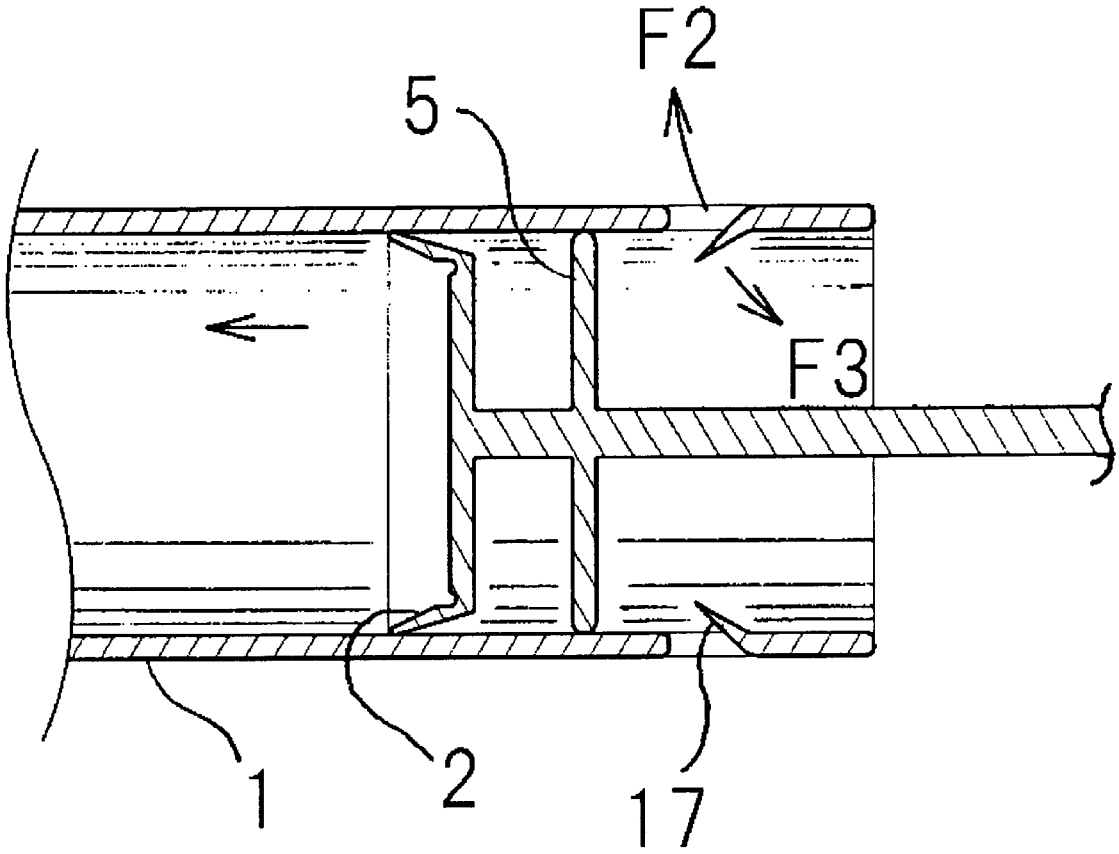
FIG. 16 is a cross-sectional enlarged view showing part of a piston pump wherein protrusion members are formed bendably to the cylinder thereof.

A Method for Introducing a Piston into a Cylinder Which is Provided in Advance with a Protruded Portion In the same manner as in Example 2, a protruded portion 17 as shown in FIG. 16 for the prevention of the slip-out of the piston is formed integral with the cylinder. On the occasion of inserting the piston 2 into the cylinder 1, when the piston 2 and the flange 5 are impinged against the protruded portion 17, the protruded portion 17 is caused to temporarily bend in the direction indicated by the arrow F2. However, as soon as the piston 2 and the flange 5 are passed through the protruded portion 17, the protruded portion 17 is allowed to move back as indicated by the arrow F3 to the original position, thereby enabling it to function to prevent the slip-out of the piston. According to this structure, the procedure of bending the bendable portion as in the case of Example 2 can be omitted, thereby making it possible to further simplify the assembling work of the piston pump.

As for the configuration of the protrusion portion 17 of this example, it may be optionally selected as long as it is capable of preventing the slip-out of the piston. The number of this protrusion portion 17 may be only one or more.

In view of the flexibility for bending the protrusion portion formed integral with the cylinder and also in view of the manufacturing cost, the material for the cylinder should desirably be selected from a resilient and unbreakable plastics such as polypropylene.

EXAMPLE 4

Figure 18:
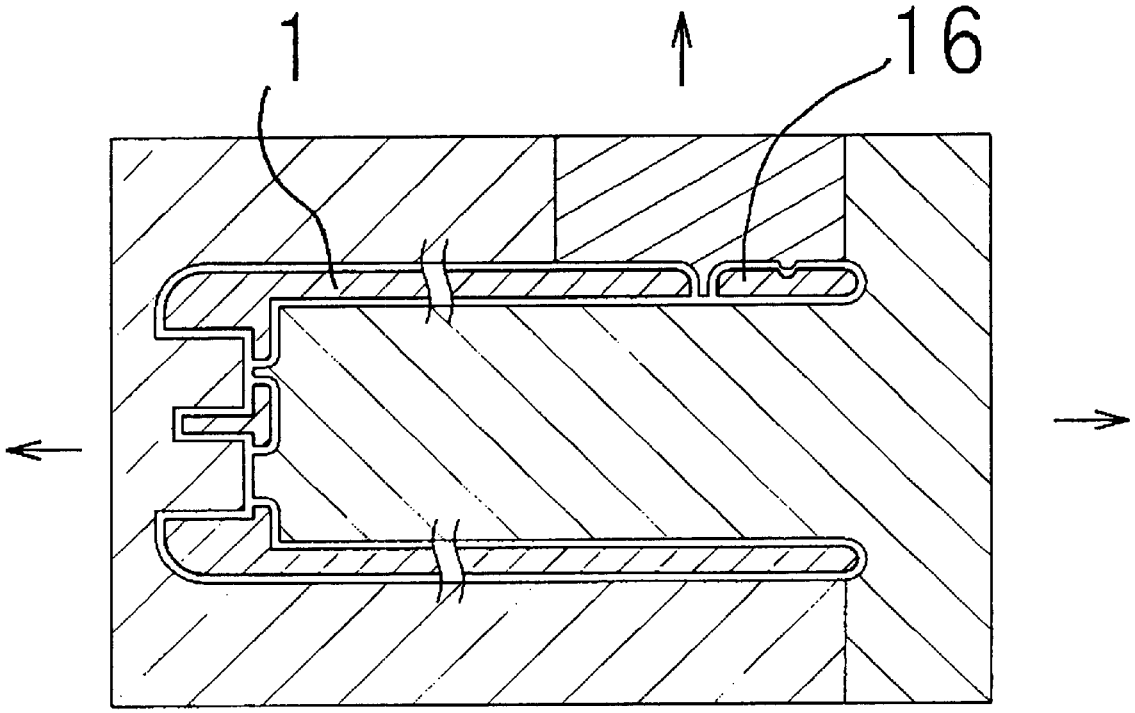
FIG. 18 is a cross-sectional view of a mold for forming a cylinder provided with bendable protrusions.
Figure 19:
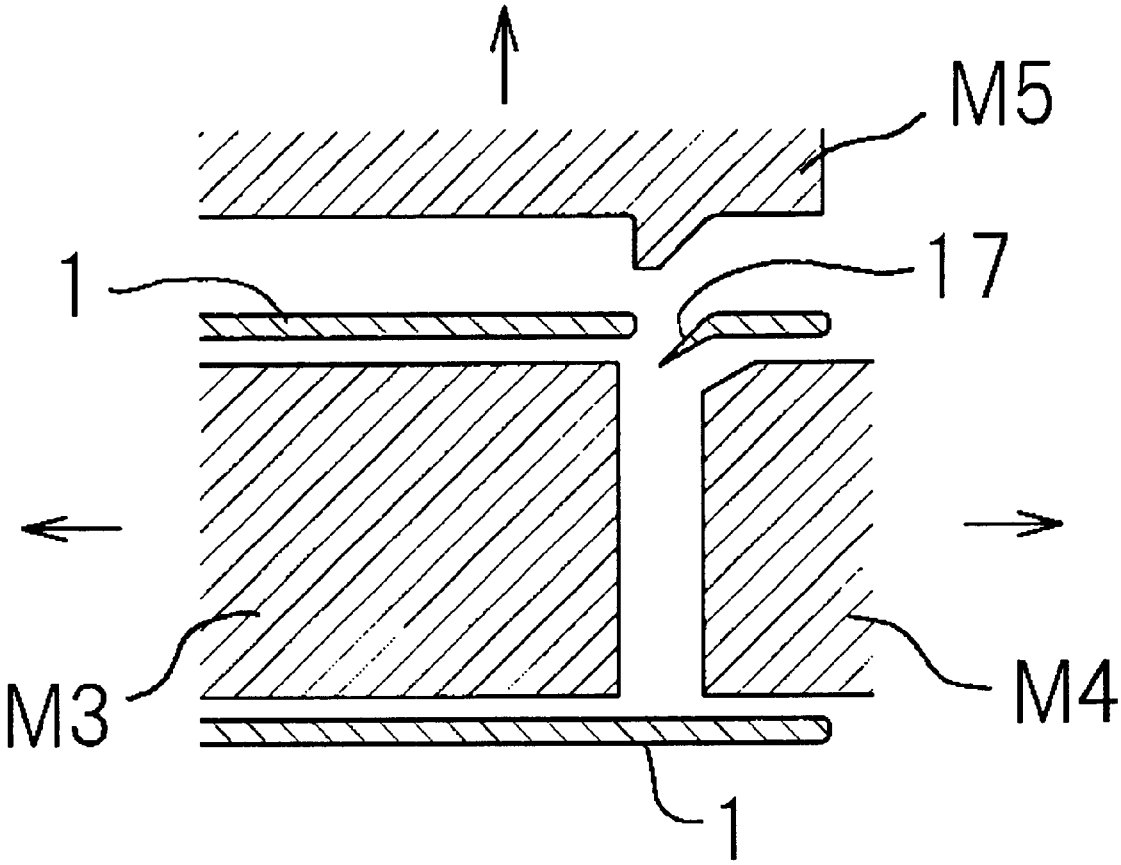
FIG. 19 is a cross-sectional view of a mold for forming a cylinder provided with resilient protrusions.

A Method for Integrally Molding a Bendable Protruded Portion on the Outside of the Cylinder As shown in FIG. 17, if a bendable protruded portion 16 is to be positioned in advance on the outside of the cylinder 1 and molded integral with the cylinder, the mold for the cylinder 1 can be made into a two-piece mold, i.e. a female mold M1 for the outside of the cylinder and a male mold M2 for the inside of the cylinder (see FIG. 17). Further, since the male mold M2 for the inside of the cylinder can be pulled out unidirectionally in this case, one end of the cylinder can be molded into a cap-like closed configuration. Whereas in the case of the cylinder of Example 2 as shown in FIG. 11 where the bendable protruded portion 16 is formed by forming the cut portions 15 in the cylinder 1, the mold for the cylinder is required to be made into a three- or more-piece mold as shown in FIG. 18, thereby increasing the manufacturing cost. In the case of the cylinder of Example 3 as shown in FIG. 16 also where the molds M3 and M4 for the inside of the cylinder are required to be pulled out bidirectionally as shown in FIG. 19, the mold for the cylinder is required to be made into a three- or more-piece mold (including the mold M5 for the outside of the cylinder).

Figure 20:
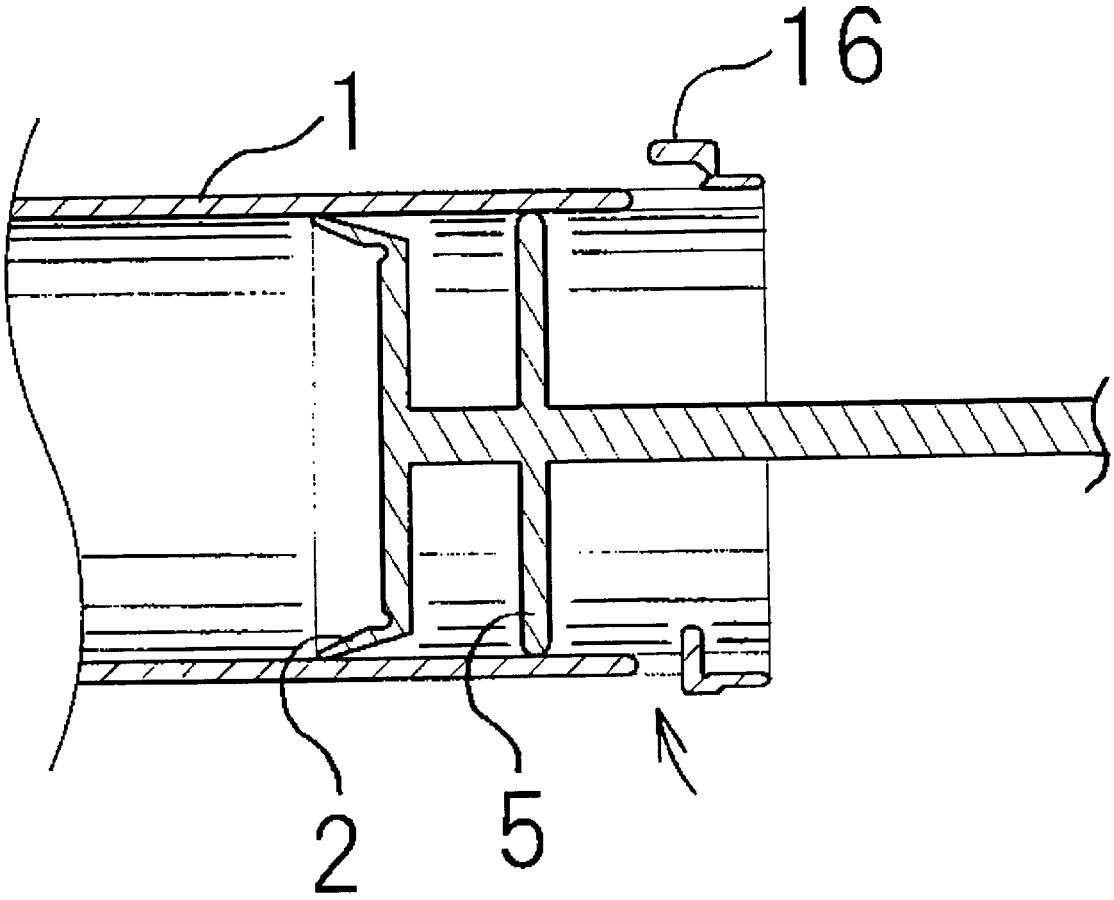
FIG. 20 is a cross-sectional enlarged view showing part of a piston pump wherein protrusion members are formed bendably to the outside of cylinder thereof.
Figure 21:
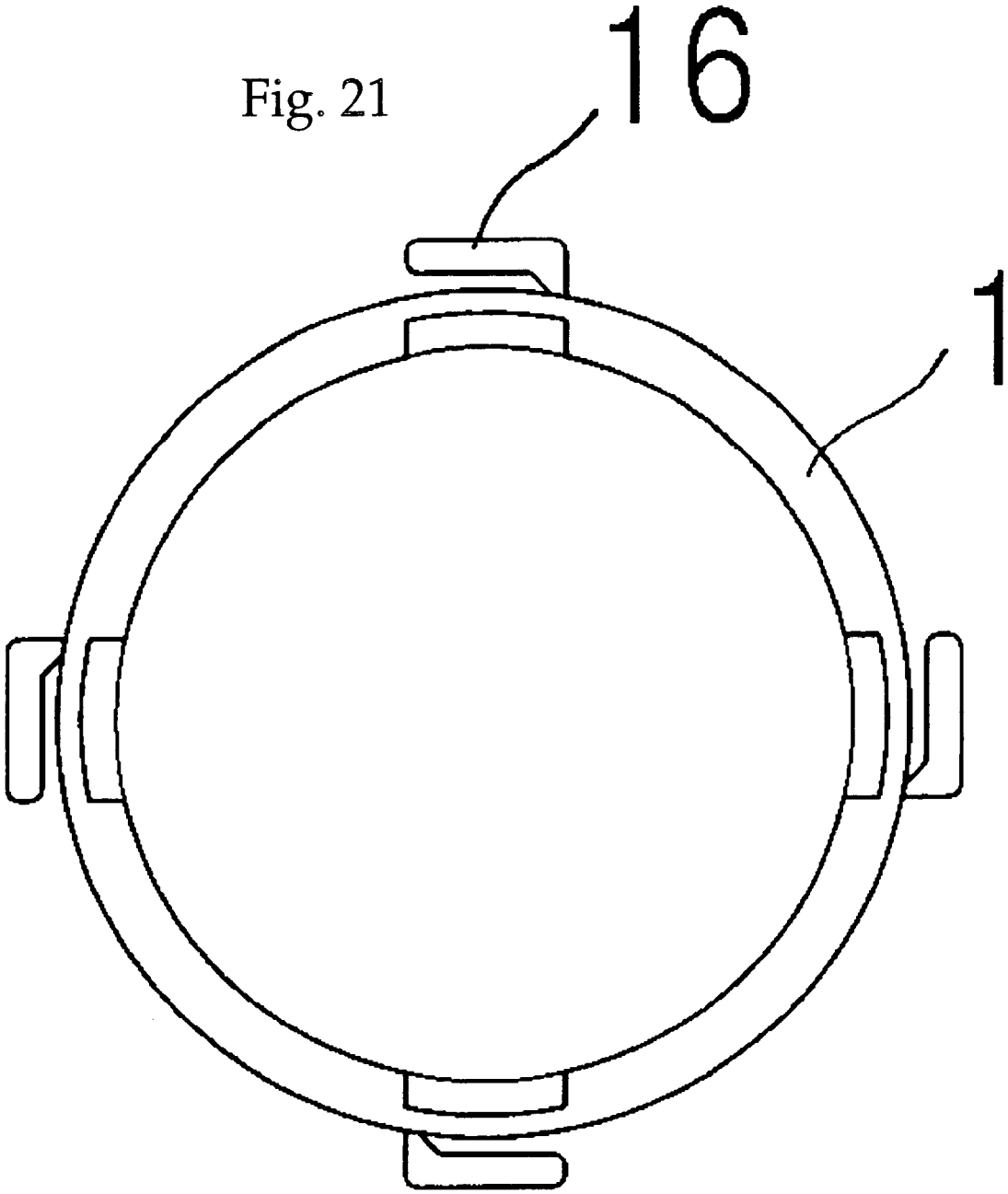
FIG. 21 is a side view showing one example of the cylinder provided on the outside of thereof with bendable protrusions as it is viewed from the piston inlet side.
Figure 22:
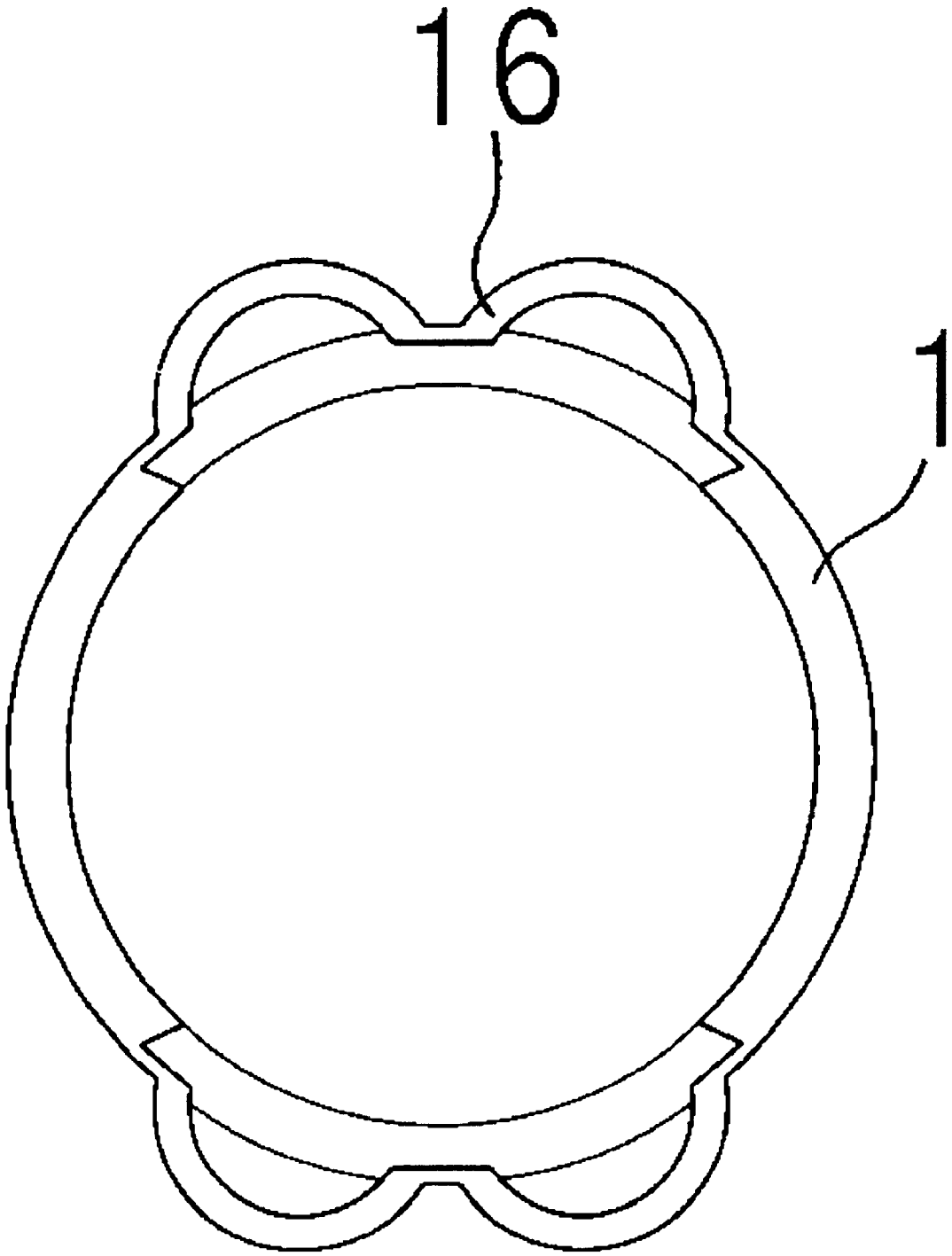
FIG. 22 is a side view showing one example of the cylinder provided on the outside of thereof with bendable protrusions as it is viewed from the piston inlet side.
Figure 23:
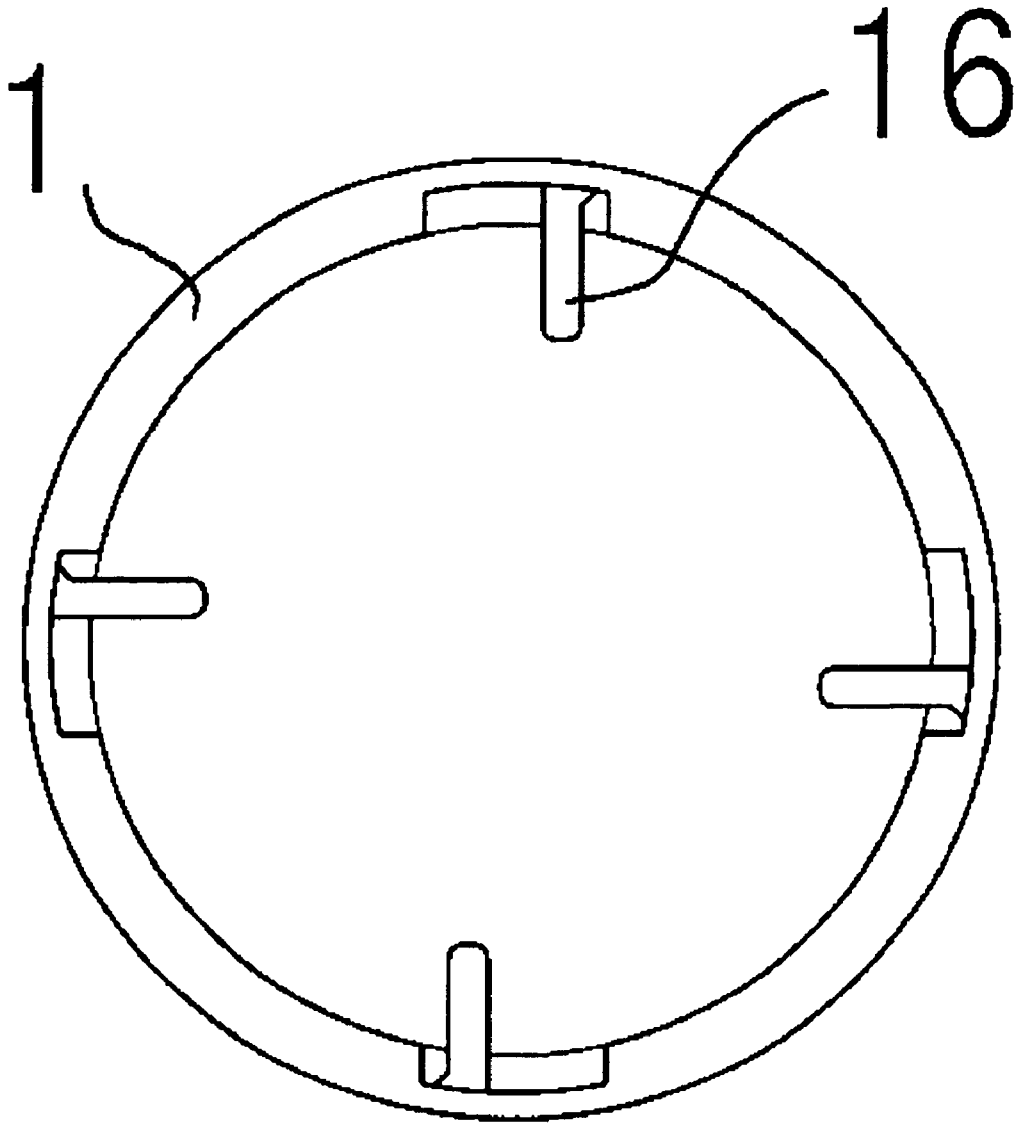
FIG. 23 is a side view, as it is viewed from the piston inlet side, showing one example of the cylinder provided with bendable protrusions which have been bent inward.
Figure 24:
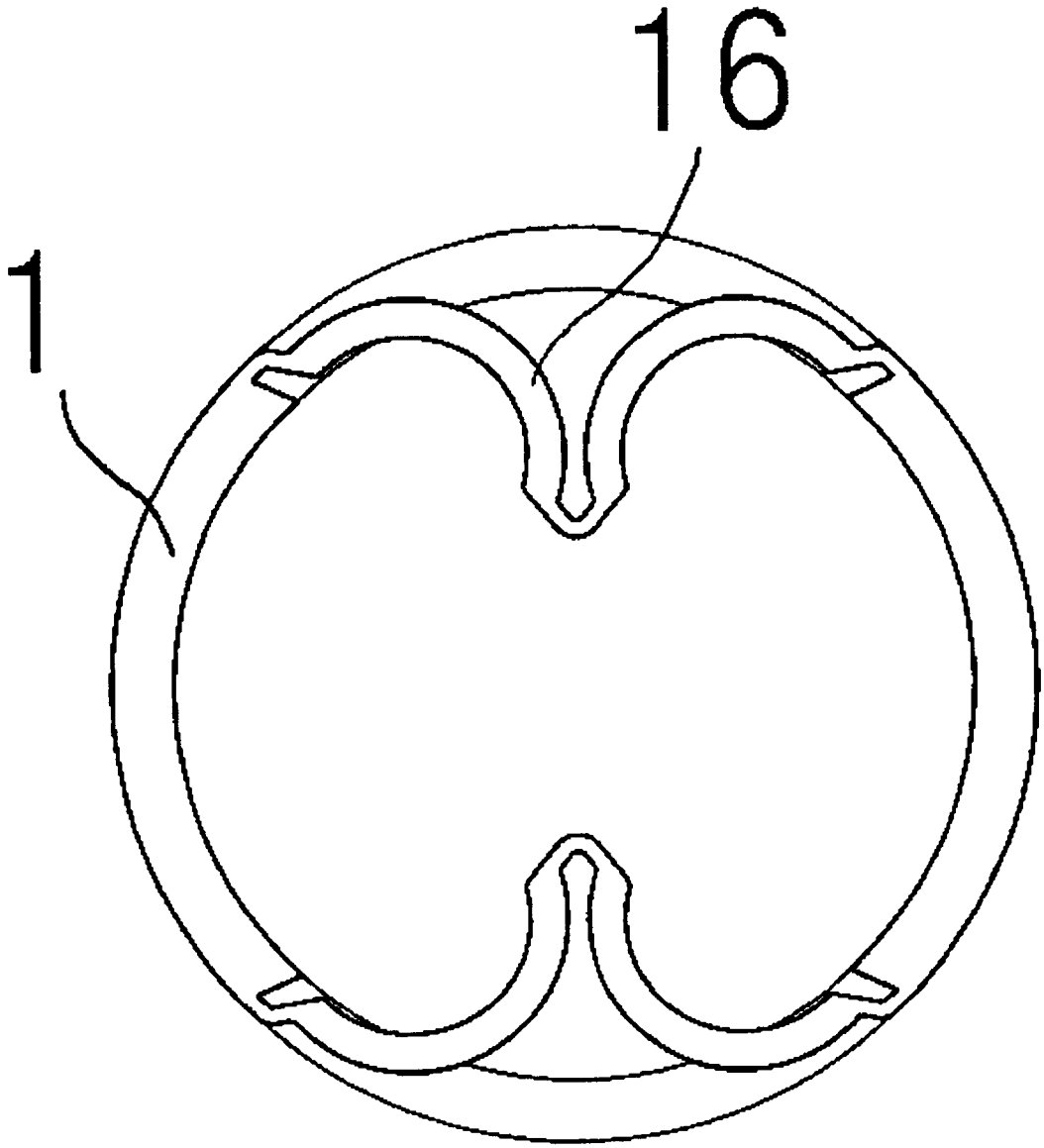
FIG. 24 is a side view, as it is viewed from the piston inlet side, showing one example of the cylinder provided with bendable protrusions which have been bent inward.

As shown in FIG. 20, when the bendable protruded portion 16 is bent inward, the protruded portion 16 can be functioned to prevent the slip-out of the piston. The number of this bendable protrusion portion 16 may be only one or more. As for the configuration of this bendable protrusion portion 16, it may be optionally selected as long as it is capable of preventing the slip-out of the piston. For example, it may be constructed as shown in FIGS. 21 and 22. Namely, when the bendable protrusion portion 16 shown in FIG. 21 is bent inside the cylinder 1, the side view thereof as viewed from the operating grip side will become as shown in FIG. 23. On the other hand, when the bendable protrusion portion 16 shown in FIG. 22 is bent inside the cylinder 1, the side view thereof as viewed from the operating grip side will become as shown in FIG. 24.

Figure 25:
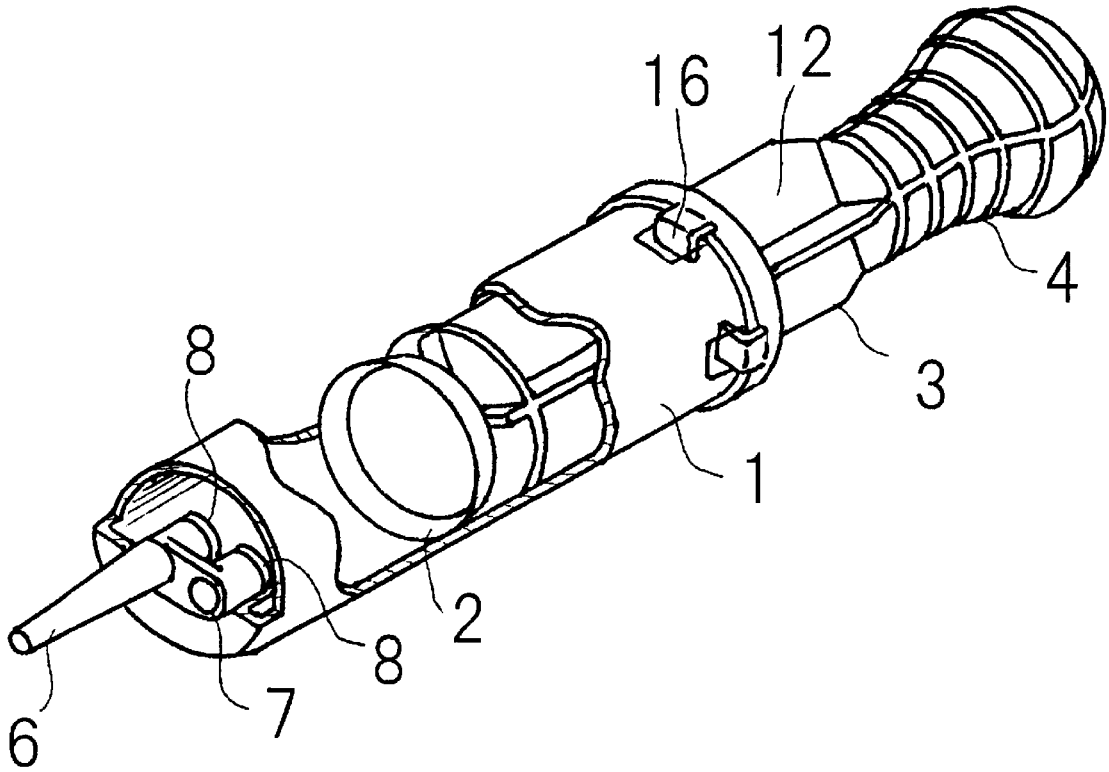
FIG. 25 is a partially cut perspective view of a piston pump.

When the constituent components for the simplified piston pump are constituted by the cylinder of Example 4 which is provided with the bendable protruded portion as shown in FIG. 20, and an integrally molded body comprising a piston, a piston shaft and an operating grip as shown in FIG. 3, the piston pump can be manufactured by making use of only four kinds of components as shown in FIG. 25, i.e. the cylinder 1 provided with a bendable protruded portion; an integral body consisting of the nozzle 6 and the intake port 7; the rubber valve 8; and an integral body consisting of the piston 2, the piston shaft 3 and the operating grip 4. Moreover, the assembling work thereof can be simplified, thus greatly reducing the manufacturing cost of the piston pump.

As explained above, according to the simplified piston pump of the present invention, since the cylinder provided with a protruded portion, and the piston shaft having a decentering-preventive function and a groove portion are co-used, the piston can be prevented from being slipped out and at the same time, the decentering of the piston shaft can be prevented without necessitating the employment of the bearing cap. Furthermore, since the bearing cap can be dispensed with, the piston shaft can be molded integral not only with the piston but also with the operating grip. Therefore, the number of parts or components can be greatly reduced and at the same time, the assembling work thereof can be simplified, thus making it possible to provide a simplified piston pump which can be manufactured at low cost.

What is claimed is:

1. A balloon hand pump operated by a reciprocating motion of a piston, the pump comprising:

a cylinder having an axis of elongation;

a piston axially reciprocal within the cylinder;

a protruding structure formed at least at one location on the inside of an upper portion of the cylinder for preventing the piston from coming out of the cylinder; and a piston shaft coupled to the piston, the piston shaft having a cross-sectional configuration such that at least a portion of the outer surface of the piston shaft contacts the inner surface of the cylinder, to thereby prevent the piston shaft from becoming eccentric, and such that a portion of the outer surface of the piston shaft is spaced from the inner surface of the cylinder and axially aligned with the protruding structure for ensuring the reciprocating motion of the piston by avoiding abutment of the piston shaft with the protruding structure.

2. The balloon hand pump according to claim 1, wherein the portion of the piston shaft spaced from the cylinder wall is formed by triangularly shaping the cross-section of the piston shaft.

3. The balloon hand pump according to claim 1, wherein the portion of the piston shaft spaced from the cylinder wall is formed by providing a circular piston shaft with an axially extending groove in the outer surface thereof.

4. The balloon hand pump according to claim 1, wherein the protruding structure on the inside of the upper part of the cylinder is integrally formed with the cylinder.

5. The balloon hand pump according to claim 1, wherein the protruding structure on the inside of the upper part of the cylinder is attached to the cylinder.

6. The balloon hand pump according to one of claims 1–5, further comprising an operating grip at the end of the piston shaft opposite from the piston and wherein the piston, the piston shaft, and the operating grip are integrally formed.

* * * * *